US007855699B2

(12) United States Patent
Shirasaki et al.

(10) Patent No.: US 7,855,699 B2
(45) Date of Patent: Dec. 21, 2010

(54) DRIVE DEVICE AND A DISPLAY DEVICE

(75) Inventors: Tomoyuki Shirasaki, Higashiyamato (JP); Manabu Takei, Sagamihara (JP)

(73) Assignee: Casio Computer Co., Ltd., Tokyo (JP)

( * ) Notice: Subject to any disclaimer, the term of this patent is extended or adjusted under 35 U.S.C. 154(b) by 778 days.

(21) Appl. No.: 11/207,113

(22) Filed: Aug. 18, 2005

(65) Prior Publication Data

US 2006/0017668 A1 Jan. 26, 2006

Related U.S. Application Data

(63) Continuation of application No. PCT/JP2004/004041, filed on Mar. 24, 2004.

(30) Foreign Application Priority Data

Mar. 25, 2003 (JP) ..... 2003-082465

(51) Int. Cl.
*G09G 3/30* (2006.01)

(52) U.S. Cl. ..... 345/76; 345/103

(58) Field of Classification Search ..... 345/76, 345/103; 375/264, 242, 286; 370/235, 477
See application file for complete search history.

(56) References Cited

U.S. PATENT DOCUMENTS 5,637,798 A * 6/1997 Schatz ..... 73/514.32
5,721,563 A 2/1998 Memida
6,222,357 B1 * 4/2001 Sakuragi ..... 323/315
6,366,026 B1 4/2002 Saito et al.
6,429,601 B1 8/2002 Friend et al.
6,597,335 B2 * 7/2003 Yasunishi et al. ..... 345/89
6,603,450 B1 8/2003 Yamazaki et al.
7,042,426 B2 * 5/2006 Shin ..... 345/76

(Continued)

FOREIGN PATENT DOCUMENTS

EP 0 837 445 A1 4/1998

(Continued)

OTHER PUBLICATIONS

T. Shima et al; Principle and Applications of an Autocharge-Compensated Sample and Hold Circuit; IEEE Journal of Solid-State Circuits, Aug. 1995, pp. 906-911.

*Primary Examiner*—Amr Awad
*Assistant Examiner*—Yong Sim
(74) *Attorney, Agent, or Firm*—Holtz, Holtz, Goodman & Chick, PC

(57) ABSTRACT

A display device includes a display panel having rows of scanning lines and columns of data lines; and a matrix of display pixels near intersections of the scanning lines and the data line. A scanning driver circuit which selects display pixels of rows connected to some of the scanning lines, and a signal driver generates display data for each display pixel. The display panel has scanning line groups which constitute sets of scanning lines through which simultaneous selection is performed by the scanning driver circuit; a plurality of scanning signal lines connected to each of the scanning line groups; and a plurality of data line groups which constitute sets of the data lines corresponding to a line count of the display pixels of the rows connected to each of the scanning line groups within the data lines.

29 Claims, 17 Drawing Sheets

U.S. PATENT DOCUMENTS

| | | | | |
|---|---|---|---|---|
| 7,176,858 | B2 * | 2/2007 | Iwabuchi et al. | 345/76 |
| 7,205,967 | B2 * | 4/2007 | Morishige et al. | 345/77 |
| 2002/0167479 | A1 | 11/2002 | Janssen et al. | |
| 2003/0040149 | A1 * | 2/2003 | Kasai | 438/200 |
| 2003/0085859 | A1 * | 5/2003 | Lee | 345/87 |
| 2003/0122808 | A1 * | 7/2003 | Sase | 345/204 |
| 2004/0125046 | A1 * | 7/2004 | Yamazaki et al. | 345/1.3 |
| 2004/0130560 | A1 * | 7/2004 | Matsueda et al. | 345/692 |

FOREIGN PATENT DOCUMENTS

| | | | |
|---|---|---|---|
| EP | 1 260 958 | A2 | 11/2002 |
| EP | 1288901 | A2 | 3/2003 |
| JP | 1982-114189 | A | 7/1982 |
| JP | 2000-56730 | A | 2/2000 |
| JP | 2000-081920 | A | 3/2000 |
| JP | 2002-152565 | A | 5/2002 |
| JP | 2002-198174 | A | 7/2002 |
| JP | 2002-351400 | A | 12/2002 |
| JP | 2003-15604 | A | 1/2003 |
| JP | 2003-043952 | A | 2/2003 |
| WO | WO 94/00962 | A1 | 1/1994 |
| WO | WO 02/39420 | A1 | 5/2002 |
| WO | WO 03/001496 | A1 | 1/2003 |
| WO | WO 2004/003877 | A2 | 1/2004 |
| WO | WO 2004/006218 | A2 | 1/2004 |

* cited by examiner

| DISPLAY NOTATION | WRITE-IN PERIOD ( $\mu$ sec) | SCALE FACTOR |
|---|---|---|
| T(1) | 22 | 1 FOLD (NORMAL) |
| T(2) | 44 | 2 FOLD |
| T(4) | 88 | 4 FOLD |
| T(6) | 132 | 6 FOLD |
| T(8) | 176 | 8 FOLD |
| T(12) | 264 | 12 FOLD |

| DISPLAY NOTATION | Sa | Sb | Sc | Sd | Se |
|---|---|---|---|---|---|
| SCREEN SIZE (NUMBER OF PIXELS) | 1.6" 60000pix | 2.04" 60000pix | 2.04" 120000pix | 3.5" QVGA | 37" Hi vision |
| NUMBER OF HORIZONTAL PIXELS | 280 | 128 | 176 | 320 | 1365 |
| NUMBER OF VERTICAL PIXELS | 220 | 160 | 240 | 240 | 768 |
| WIRING CAPACITY OF THE DATA LINES | 3.6pF | 3.1pF | 4.0pF | 4.7pF | 19.9pF |

DRIVE DEVICE AND A DISPLAY DEVICE

This is a Continuation Application of PCT application No. PCT/JP2004/004041 filed on Mar. 24, 2004.

TECHNICAL FIELD

This invention relates to a drive device which drives a display panel comprising a plurality of display pixels having current control type display devices, and more particularly a display device comprising the drive device and associated drive method with regard to the display device comprising the drive device and the drive device.

BACKGROUND ART

In recent years, the spread of flat panel type display devices as monitors and displays of personal computers and video equipment has been remarkable. Particularly, Liquid Crystal Displays (hereinafter denoted as "LCD") have many advantages as these devices are thin-shaped, space-saving, low-powered and the like as compared to conventional display devices.

Furthermore, as the next-generation display device technology which supplants current LCD's, Research and Development (R&D) of a self-luminescence type display devices (self-luminescence type displays) equipped with a display panel which performs two-dimensional digital array of the display pixels is being actively developed. These LCD's comprise a self-luminescence type display device composed of light emitting devices to perform luminescent operation according to the display data and extensively employ organic electroluminescent devices (hereinafter denoted as "organic EL devices") or Light Emitting Diodes (LEDs) and the like.

Such self-luminescence type displays as compared to LCD's have rapid display response speed to moving images and there is no angle-of-visibility dependability. Additionally, because backlight is not needed like an LCD, higher luminance with a greater contrast ratio, higher resolution of the display image quality together with using low-power are attainable. These very predominant features will lead to extremely thin-shaped and lightweight models and full-scale utilization of such self-luminescence type displays are expected in the near future.

In self-luminescence type display configurations which apply an active-matrix drive method, various drive control mechanisms and control methods of the display pixels comprising a display device composed of light emitting devices constituted of a plurality of switching elements for controlling operation of the light emitting devices have been proposed.

FIGS. 15A and 15B are equivalent circuit drawings showing prior art example configurations as in the case of the display pixels applied to organic EL devices OEL as the light emitting devices in a self-luminescence type display.

The configuration shown in FIG. 15A comprises a voltage application method which is constituted with a light generation driver circuit DP1 comprising an n-channel type Thin-Film Transistor (TFT) Tr111, a p-channel type Thin-Film Transistor Tr112, a capacitor CP1 and the organic EL devices OEL. The light generation driver circuit DP1 comprises the n-channel type Thin-Film Transistor (TFT) Tr111 (hereinafter denoted as "Nch transistor") whereby the gate terminal is connected to the scanning lines SL, along with the source terminal and the drain terminal each other connected to the data lines DL and the contact point N111 (hereinafter denoted as "contact" for the convenience of explanation) each near the intersecting point of a plurality of scanning lines SL and data lines DL arranged in matrix form in the display panel; the capacitor CP1 gate terminal is connected to contact N111 which is connected in between the p-channel type Thin-Film Transistor Tr112 (hereinafter denoted as "Pch transistor") source terminal by which ground potential Vgnd is applied along with the contact N111 and the Pch transistor Tr112 gate terminal; and the organic EL devices OEL whereby the anode terminal is connected to the drain terminal of the Pch transistor Tr112 of the light generation driver circuit DP1 and the low power supply voltage Vss of low electric potential is applied to the cathode terminal lower than the ground potential Vgnd.

In this configuration, the gradation signal voltage Vpix according to the display data is applied to the data lines DL. When a high-level scanning signal Vsel is applied to the scanning lines SL and the display pixels are set to a selection state, the Nch transistor Tr111 in the light generation driver circuit DP1 performs an "ON" operation. The gradation signal voltage Vpix is applied to the data lines DL via Nch transistor Tr111 to the contact N111, specifically the gate terminal of Pch transistor Tr112. Accordingly, the Pch transistor Tr112 performs an "ON" operation by the switch-on state according to the above-mentioned gradation signal voltage Vpix and predetermined light generation drive current flows to the low voltage Vss via the Pch transistor Tr112 and the organic EL devices OEL from the ground potential Vgnd. Thus, the organic EL devices OEL perform luminescent operation by the luminosity gradation according to the above-mentioned display data. Subsequently, when a low-level scanning signal Vsel is applied to the scanning lines SL and the display pixels are set to a non-selection state, the Nch transistor Tr111 performs an "OFF" operation. Although the data lines DL and the light generation driver circuit DP1 are electrically blocked out, the voltage applied to the gate terminal of Pch transistor Tr112 is stored by the capacitor CP1 (parasitic capacitance) and one frame periods are performed.

Additionally, the configuration shown in FIG. 15B comprises a current application method which is constituted with the light generation circuit DP2 comprising an Nch transistor Tr121, Pch transistors Tr122 to Tr124, a capacitor CP2 and the organic EL devices OEL. The light generation circuit DP2 comprises the Nch transistor Tr121 gate is connected to first scanning lines SL1, along with the source terminal and drain terminal each other connected to the data lines DL and the contact N121 near the intersecting point of the first and second scanning lines SL1 and SL2 arranged in parallel to each other and the data lines DL; the Pch transistor Tr122 gate terminal is connected to the second scanning lines SL2, along with the source terminal and drain terminal each other connected to the contact N121 and contact N122; the Pch transistor Tr123 gate terminal is connected to the contact N122, along with the drain terminal each other connected to the contact N121 and the high voltage Vdd applied to the source terminal; the Pch transistor Tr124 gate terminal is connected to the contact N122 and the high voltage Vdd is applied to the source terminal; the capacitor CP2 is connected between the gate-source of the Pch transistors Tr123 and Tr124; and the organic EL devices OEL in which the anode terminal is connected to the drain terminal of Pch transistor Tr124 and the ground potential is applied to the cathode terminal.

In this configuration, the gradation current Ipix according to the display data is applied to the data lines DL. When the high-level scanning signal Vsel1 to the scanning lines SL1 and the low-level scanning signal Vsel2 to the scanning lines SL2 are each other applied and the display pixels are set to the selection state, the transistors Tr121 and Tr122 in the light generation driver circuit DP2 perform an "ON" operation. While the gradation current Ipix according to the display data applied to the data lines DL is taken in at the contact N122 via the transistors Tr121 and Tr122, the current level of this gradation current Ipix is converted to the voltage level by the Pch transistor Tr123 and predetermined voltage is generated between the gate-source. Subsequently, when the high-level scanning signal Vsel2 is applied to the scanning lines SL2, the Pch transistor Tr122 performs an "OFF" operation. The voltage generated between the gate-source of the Pch transistor Tr123 is stored by the capacitor CP2 (parasitic capacitance). Next, when the low-level scanning signal Vsel1 is applied to the scanning lines SL1, the Nch transistor Tr121 performs an "OFF" operation. The data lines DL and the light generation driver circuit DP2 are electrically blocked out and the Pch transistor performs an "ON" operation according to the electric potential difference based on the voltage stored in the above-mentioned capacitor CP2. As a result, predetermined light generation drive current from the high power supply voltage Vdd flows to ground potential via the Pch transistor Tr124 and the organic EL devices OEL, which is controlled so that the organic EL devices OEL emit light by the luminosity gradation according to the display data and one frame periods are performed.

Although the pixel driver circuit of the current application method as shown in the above-mentioned FIG. 15B has the advantage of not be being easily influenced by the effects of fluctuation or varying operating characteristics of each of the Thin-Film Transistors in the light generation driver circuit as opposed to the voltage application method as shown in FIG. 15A, there is an inherent problem with regard to writing gradation currents to each of the display pixels at the time of low gradation with comparatively low luminosity.

Accordingly, although it is necessary to supply and write-in gradation current to each of the display pixels which has a relatively low current value at the time of low luminosity gradation, the operation which writes in gradation currents in the display pixels is equivalent to charging the capacity component, such as the wiring capacitor and the like, which is parasitic on the data lines to predetermined voltage. For example, in the case where the wire length of the data lines is designed to be lengthened by enlargement of the display panel and the like, or the number of scanning lines are increased and high resolution is performed. Therefore, when the selection period of each of the scanning lines is set briefly to the extent that the current value of the gradation currents becomes low, the charging time period of the data lines requires more time and the time period required for the write-in operation to the display pixels becomes longer. Furthermore, by using the write-in time set beforehand, the pixels become written insufficiently and luminosity differences occur within the display panel.

FIG. 16 is the simulation results for illustrating the influence of the write-in characteristics on the display data in various types of display panels.

FIG. 17 is the simulation results for illustrating the influence of the write-in characteristics on the wiring capacitor in various types of display panels.

Here, the simulation results shown in FIGS. 16 and 17, illustrated in FIG. 16 as Sa~Se, the size, the number of pixels and the like of the display panels, as well as the write-in rate of the display data in five types of displays which have respectively different specifications are shown.

The inclination of the write-in rate of the display data in low gradation drops significantly and the resultant write-in deficiency is shown as the display panel is enlarged the number of display pixels increases. In FIG. 16 as illustrated in each of the characteristic curves Sa-Se, shown is the correlation of the write-in rate to the gradation (write-in gradation) of the display data.

In addition, the inclination of the write-in rate of the display data drops significantly and the resultant write-in deficiency is shown as the display panel is enlarged the wire length of the data lines becomes longer and the distance from the data driver becomes lengthier. In FIG. 17 as illustrated in each of the characteristic curves Sa~Se, shown is the correlation of the write-in rate to the arrangement position of the display pixels on the display panel.

DISCLOSURE OF THE INVENTION

The present invention has been made in view of the circumstances mentioned above. Accordingly, it is the primary object of the present invention to provide a drive device which drives a display panel comprising a plurality of display pixels which have current drive type display devices and set to a display device comprising this drive device which displays desired image information, as well as at the time of the write-in operation of the display data to the display pixels, deterioration of the display image quality due to write-in deficiency can be controlled. Thus, the present invention has an advantage to acquire satisfactory display image quality relative to higher resolutions and enlargement of the display panel.

The driver circuit in the present invention for acquiring the above-mentioned advantage comprises at least a display panel having a plurality of display pixels comprising at least a pixel selection circuit for setting simultaneously to the selection state the plurality of the display pixels which are arranged in a plurality of rows; a current generation circuit in which gradation signals that provide the display gradation of each of the display pixels are supplied and for generating signal currents having a current value according to the value of the gradation signals; and a plurality of current holding circuits in which the signal currents are supplied and which take in and hold the signal currents corresponding to the plurality of display pixels which are set to the selection state by the pixel selection circuit and for outputting simultaneously the gradation currents to each of the display pixels in the plurality rows based on the signal currents.

The current generation circuit comprises a means which outputs sequentially the signal currents as time series data to the current holding circuits corresponding to the plurality of display pixels of coinciding columns in the signal currents corresponding to the display pixels of the plurality of rows set to the selection state by the pixel selection circuit.

Additionally, the current holding circuits have a first timing operation which holds the voltage component corresponding to the signal currents outputted from the current generation circuit; and a second timing operation which outputs the currents corresponding to the voltage component as the gradation currents. The plurality of current holding circuit comprise a portion which takes in sequentially a plurality of signal currents corresponding to the plurality of display pixels of each column of a plurality of rows set to the selection state according to the time series timing of the signal currents and gradation currents based on the signal currents are outputted simultaneously to each of the plurality of display pixels for every column of the plurality of display pixels of the plurality of rows set to the selection state by the pixel selection circuit. Each of the plurality of current storage circuits comprises a pair of current storage sections arranged in parallel and are controlled to perform simultaneously in parallel an operation which takes in and holds the signal currents outputted to one side of the current storage sections from the current generation circuit; and an operation which supplies the gradation currents to the data lines based on the signal currents held in the other side of the current storage sections. The current storage sections comprise voltage component holding sections which take in the signal currents outputted from the current generation circuit and held as the voltage component corresponding to the current value of the signal currents, for example, consists of a capacitative element.

The display device in the present invention for acquiring the above-mentioned advantage comprises at least a display panel comprising a plurality of scanning lines arranged in rows and a plurality of data lines arranged in columns, and a plurality of display pixels arranged in matrix form near the intersecting points of the plurality of scanning lines and data lines;

a scanning driver circuit which selects simultaneously some of a plurality of scanning lines of the plurality of scanning lines of the display panel; a signal driver circuit comprises a current generation circuit in which the display data that provides the display gradation of each of the display pixels is supplied and which generates signal currents having a current value according to the value of the display data; and a plurality of current holding circuits in which the signal currents are supplied and which take in and hold the signal currents corresponding to the display pixels of a plurality of rows selected by the scanning driver circuit and outputs simultaneously the gradation currents to each of the plurality of display pixels in the plurality of scanning lines based on the signal currents.

The display panel comprising a plurality of scanning line groups which constitute sets of the plurality of scanning lines through which simultaneous selection is performed by the scanning driver circuit; a plurality of scanning signal lines which are connected to each of the plurality of scanning line groups; and a plurality of data line groups which constitute sets of the plurality of data lines corresponding to the line count of the display pixels of the plurality of rows connected to each of the scanning line groups within the plurality of data lines. The scanning driver circuit sequentially applies the scanning signal to each of the plurality of scanning signal lines. The plurality of display pixels are a herein the scanning driver circuit sequentially applies the scanning signal to each of the plurality of scanning signal lines arranged near each intersecting points of each of the scanning lines and each of the data line groups. The data line groups are arranged within each area between the sequences of each other of the display pixels arranged in the display panel.

The current generation circuit comprises a portion which generates and outputs the signal currents supplied to the current holding circuits as time series data corresponding to the plurality of display pixels connected to each of the plurality of data lines of each of the data line groups.

Furthermore, the plurality of current holding circuits comprises a first timing operation which holds the voltage component corresponding to the signal currents and outputs from the current generation circuit, and a second timing operation which outputs currents corresponding to the voltage component as the gradation currents. The plurality of current holding circuits comprise a portion which takes in sequentially a plurality of signal currents corresponding to a plurality of display pixels connected to a plurality of data lines of each of the data line groups according to time series timing of the signal currents, and the gradation currents based on the signal currents are supplied simultaneously to a plurality of data lines of each of the data line groups. Each these plurality of current holding circuits comprises a pair of current storage sections arranged in parallel and are controlled to perform simultaneously in parallel an operation which takes in and holds the signal currents outputted from the current generation circuit to one side of the current storage sections; and an operation which supplies the gradation currents based on the signal currents held in the other side of the current storage sections to the data lines. The current storage sections comprise a voltage component holding sections which take in the signal currents outputted from the current generation circuit and hold the voltage component corresponding to the current value of the signal currents, for example, consists of a capacitative element.

Furthermore, the display pixels comprise the pixel driver circuit which generates drive currents having a current value based on the gradation currents; and current control type display devices which operate by the display luminosity based on the current value of the drive currents. The display devices have light emitting devices which perform luminescent operation by the luminescent luminosity based on the current value of the drive currents. For example, the light emitting devices are composed of organic electroluminescent devices. The organic electroluminescent devices, for example, are provided distributed in the entire surface side of the substrate in which the scanning lines and the data lines are provided and have a top emission structure which emits the light radiated by the luminescent operation in the opposite direction of the substrate.

The drive method of the display device in the present invention for acquiring the above-mentioned advantage comprises a configuration in which the display data is supplied by the signal driver circuit that provides the display gradation of each of the display pixels and the signal currents are generated which have a current value according to the value of the display data; the signal currents are taken in sequentially and held as the signal currents corresponding to the display pixels of the plurality of rows selected by the scanning driver circuit; the gradation currents are outputted simultaneously to each of the display pixels of the plurality of rows connected to the plurality of scanning lines based on the signal currents; the plurality of scanning lines are selected simultaneously by the scanning driver circuit and the gradation currents are written in the plurality of display pixels; and the plurality of display pixels in which the gradation currents were written operate by the display luminosity based on the current value of the gradation currents. The signal currents are generated as time series data corresponding to the display pixels of the plurality of rows selected by the scanning driver circuit wherein the taking in of the signal currents are taken in sequentially as a plurality of signal currents corresponding to the display pixels of the plurality of rows according to the time series timing of the signal currents. Additionally, the taking in as the signal currents for each of the display pixels signal currents and outputting of the gradation currents are performed simultaneously in parallel based on the signal currents.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BEST MODE FOR CARRYING OUT THE INVENTION

Figure 1:
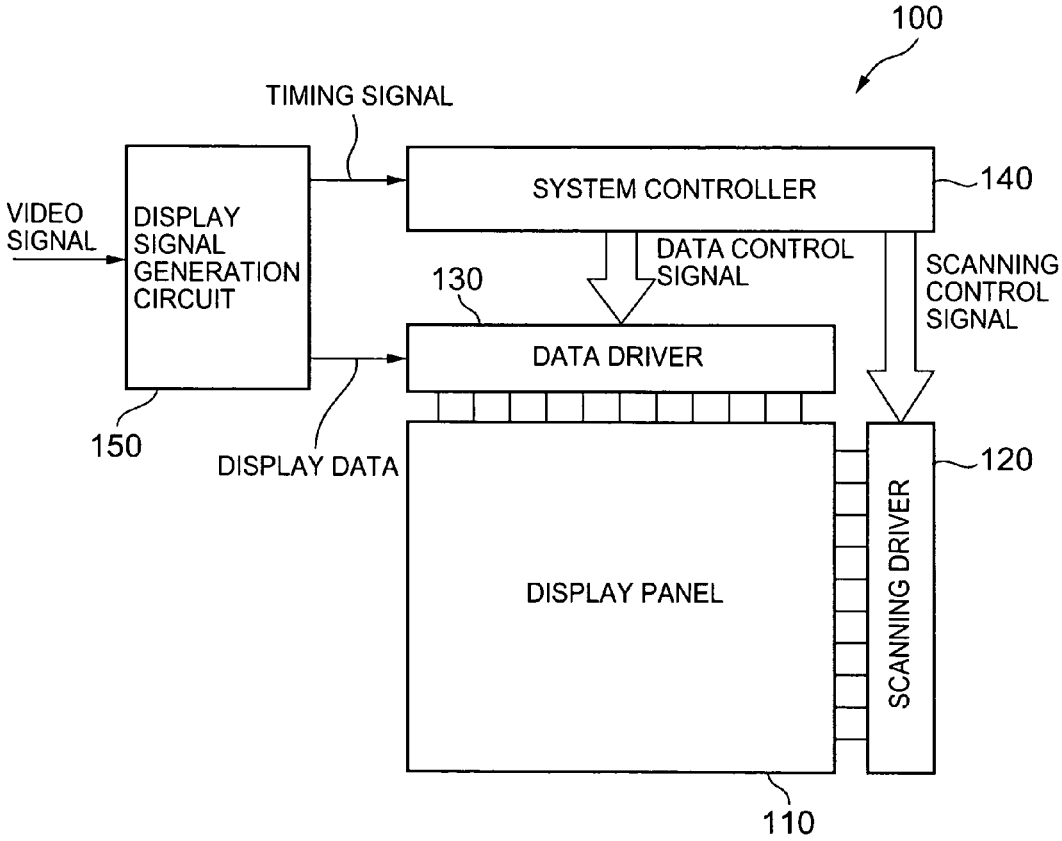
FIG. 1 is an outline block diagram showing the basic configuration of the display device related to this invention.

Hereinafter, the display device comprised with the drive device and the drive device related to the present invention together with its associated drive method will be explained based on the embodiment shown in the drawings.

<<Basic Configuration of the Display Device>>

First, the basic configuration of the display device as applied to the drive device related to the present invention will be explained with reference to the drawings.

FIG. 1 is an outline block diagram showing the basic configuration of the display device related to this invention.

Figure 2:
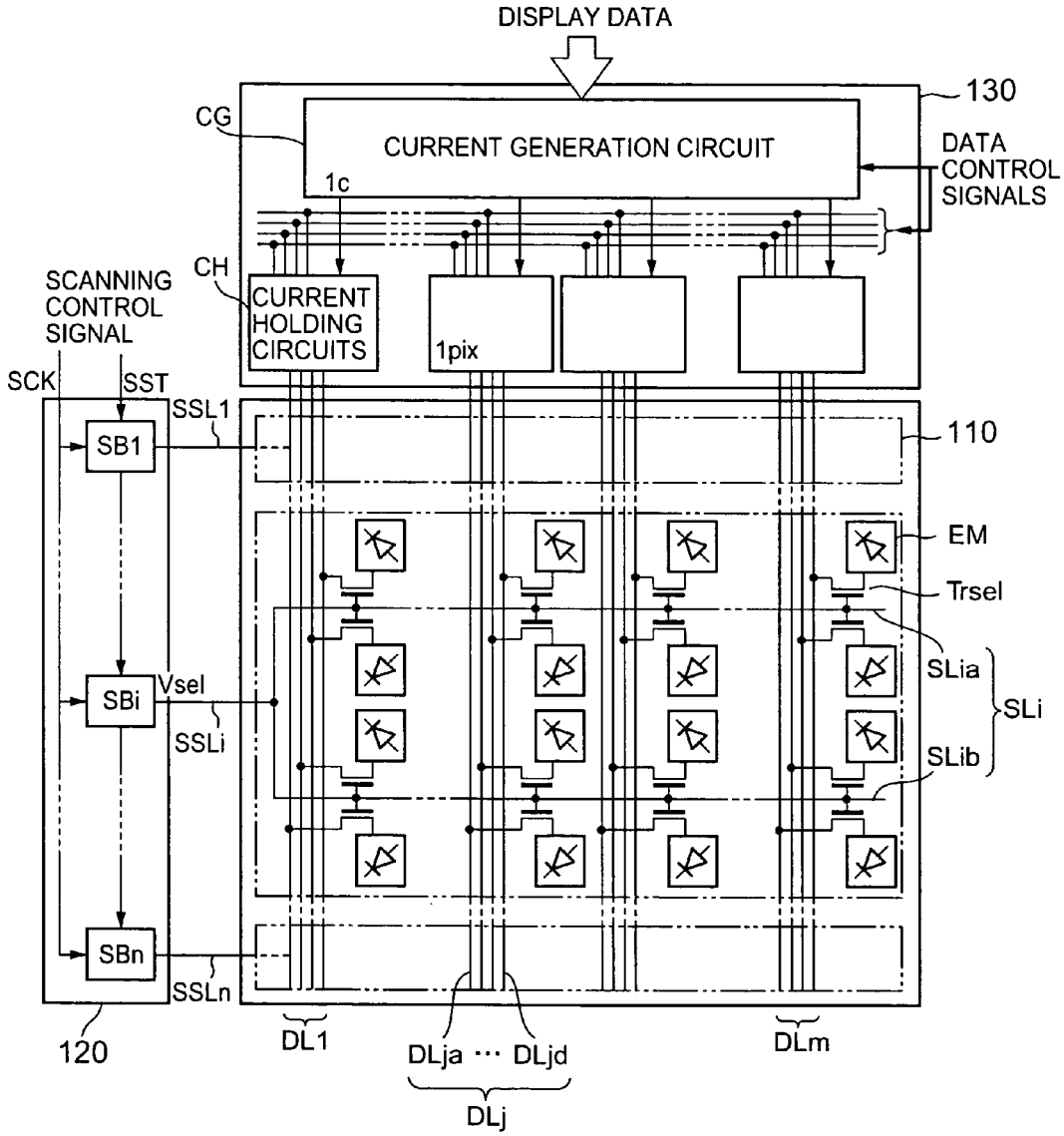
FIG. 2 is an outline block diagram showing an example of the principal parts of the display device related to this invention.

FIG. 2 is an outline block diagram showing an example of the principal parts of the display device related to this invention.

In FIG. 2, only the display pixels connected to the scanning line groups of the i-th line are shown in detail for convenience of reference.

As shown in FIGS. 1 and 2, the display device 100 related to this embodiment comprises a display panel 110, a scanning driver 120 (scanning driver circuit; pixel selection circuit), a data driver 130 (signal driver circuit), a system controller 140 and a display signal generation circuit. The main configuration comprises the display panel 110 has a plurality of groups (By the configuration shown in FIG. 2, n groups) of the scanning line groups SLi (i=1~n) and each group consists of a plurality (By the configuration shown in FIG. 2, two lines) of the scanning lines SLia, Slib which are arranged in the line writing direction (rows); a plurality of lines (FIG. 2, n lines) of the scanning signal lines SSLi (i=1~n) are connected to each scanning line group SLi; a plurality of groups (By the configuration shown in FIG. 2, m groups) of the data line groups DLj (j=1~m) and each group consists of a plurality (By the configuration shown in FIG. 2, four lines) of the data lines DLja~DLjd are arranged in columns to intersect at right angles with each scanning line group SLi; a plurality of display pixels EM are connected via the selection transistor Trsel and arranged near the intersecting point of each of the scanning lines SLia, SLib and each data line group DLj; the scanning driver 120 (scanning driver circuit; a pixel selection circuit) applies the sequential scanning signal Vsel to each scanning line group SLi sets the display pixels of a plurality of lines (By the configuration shown in FIG. 2, four lines) of each scanning line group SLi to the selection state simultaneously by connecting to each scanning signal line SSLi of the display panel 110 and applying the sequential scanning signals Vsel at predetermined timing to each scanning signal line SSLi; the data driver 130 (signal driver circuit) takes in and holds the display data supplied from the display signal generation circuit (described later) for each portion of the plurality of display pixels EM corresponding to the number of data lines of each data line group and by connecting to each data line group DL1~DLm of the display panel 110 supplies simultaneously the gradation current Ipix to the plurality of the data lines DLja~DLjd of each data line group DL1~DLm at predetermined timing; the system controller 140 generates and outputs the scanning control signals and data control signals that control the operating state of at least the scanning driver 120 and the data driver 130 based on the timing signals supplied by the display signal generation circuit 150 (described later); and the display signal generation circuit 150 extracts or generates the timing signals, such as the system clock and the like, and supplied to the system controller 140 for performing the image display of the display data on the display panel 110, while generating the display data and supplying the data driver 130.

Hereafter, each of the above-mentioned configurations will be explained in detail.

(Display Panel)

The display panel 110 applicable to the display device related to the embodiment, for example as shown in FIG. 2, has a configuration comprising a plurality of groups (n groups) of the scanning line groups SLi (i=1~n) and each group consists of two scanning lines SLia, SLib) which are arranged in the line writing direction (rows); a plurality (n lines) of scanning signal lines SSLi (i=1~n) which are connected to each scanning line group SLi; a plurality of groups (m groups) of the data line groups DLj (j=1~m) and each group consists of four data lines DLja~DLjd which are arranged in columns; and a plurality of display pixels EM which are arranged in matrix form. Two scanning lines SLia, SLib of each scanning line group SLi and four data lines DLja~DLjd of the data line groups DLj are arranged to intersect at right angles with each other. Each of the display pixels EM are arranged near each intersecting point of each of the scanning lines SLia, SLib and each of the data line groups Dlj which are connected to each scanning line and each data line.

In the configuration shown in FIG. 2, the display pixels EM for two line segments are connected respectively to each of the scanning lines SLia, SLib of the scanning line groups SLi and the display pixels EM for four line segments are connected to each scanning line group SLi. Here, the number of data lines which constitute each data line group DLj is set to correspond to the line count of the display pixels EM connected to each of the scanning line groups SLi.

In addition, the number of scanning lines which constitute each of the scanning line groups SLi, the line count of the display pixels EM connected to each scanning line and the number of data lines which constitute each data line group DLj corresponding to this is not limited in particular. As shown in FIG. 2, the scanning line groups consist of two scanning lines that may connect with the display pixels EM of four lines, the data line groups DLj may be composed of four data lines and each may be what are further composed of many numbers. The scanning lines which constitute each scanning line group may be composed from at least some of all the scanning lines that comprise the display panel 110. Furthermore, for example, you may have a configuration in which all the scanning lines that constitute the display panel 110 are a single scanning line group, whereby the display pixels EM for all line segments (one screen) are connected in common to one scanning signal line. In this case, the display pixels EM of one screen from one single scanning signal are collectively set to the selection state.

Additionally, each display pixel EM has a configuration connected to the drain terminal of the selection transistor Trsel by which the gate terminal is connected to each scanning line and the source terminal is connected to each data line, and comprises current control type light emitting devices which perform luminescent operation by predetermined luminosity gradation according to the gradation current Ipix supplied via each data line and the above-mentioned selection transistor Trsel by the data driver 130. Also, the configuration of the display pixels mentioned above expresses the composition of the display pixels in the present invention conceptually; the illustrative circuit configuration of the display pixels EM including the selection transistor and its circuit operation will be described later in detail.

In the display panel 110 which has such a configuration, when the scanning signal Vsel is applied to specified scanning signal lines SSLi by the scanning driver circuit 120 (described later), the selection transistor Trsel connected to a plurality of the scanning lines SLia, SLib of those scanning line groups SLi will perform an "ON" operation and the display pixels EM of four line segments will be collectively set to the selection state. Also, in the state (selection state) the scanning signals Vsel are applied to the scanning line groups SLi, by supplying simultaneously the gradation current Ipix corresponding to the display data of each data line group DLj from the data driver 130 (described later) via the selection transistor Trsel which performed the above-mentioned "ON" operation, the display data is collectively written into four lines of the display pixels EM set to the selection state.

(Scanning Driver)

The scanning driver 120, based on the scanning control signals supplied by the system controller 140, by performing the operation which applies sequentially the scanning signal Vsel of the selection level (for example, high-level) to each scanning signal line SSLi~SSLn, the display pixels EM for the four line segments connected to the scanning lines SLia, SLib of each of the scanning line groups SLi are set to the selection state simultaneously by the data driver 130 (described later), and controls the write-in simultaneously of the gradation current Ipix in each of the display pixels EM based on the display data supplied via each data line group DLj.

In the scanning driver 120, for example as shown in FIG. 2, the shift clocks SB1, SB2 . . . SBi, SBn constitute the shift register and buffer corresponding to each scanning signal line group SLi comprising a plurality of stages (n stages) based on the scanning control signals (scanning start signal SST, scanning clock signal SCK and the like) supplied by the system controller 140 (described later). The shift output generated while shifting sequentially from the upper part to the lower part of the display panel 110 by the shift register is applied sequentially to each of the scanning signal lines SSL1~SSLn as the scanning signal Vsel which has a predetermined selection level (high-level) via the buffer.

In addition, as mentioned above, in the case of having a configuration in which all the display pixels EM that constitute the display panel 110 are connected to the single scanning line groups SLi, the shift blocks as shown in FIG. 2 are unnecessary and applies a single scanning signal Vsel at predetermined timing to the scanning line groups SLi based on the above-mentioned scanning control signals.

(Data Driver)

The data driver 130, based on the data control signals supplied from the system controller 140, supplies the display data from the display signal generation circuit 150 (described later) and the signal currents Ic based on the display data are taken in and held at predetermined timing for each number of the data lines of each data line group DLj. Next, the display pixels EM are supplied simultaneously via each data line group by converting into gradation currents Ipix the signal currents Ic that are held at the above-mentioned timing which sets each of the scanning line groups SLi to the selection state by the scanning driver 120 mentioned above.

The data driver 130, for example as shown in FIG. 2, comprises a current generation circuit CG and a plurality of current holding circuits CH. The current generation circuit CG generates the signal currents Ic at least based on the display data. The plurality of current holding circuits CH are connected for each data line group DLj arranged in the display panel 110. Based on the data control signals supplied from the system controller 140 (described later), the signal currents Ic according to the display data supplied from the display signal generation circuit 150 are generated by the current generation circuit CG. The signal currents Ic of the four data lines of the data line groups DLj corresponding to the display pixels of four lines connected to each of the scanning lines of the scanning line groups is taken in sequentially and held at predetermined timing by the current holding circuits CH. The signal currents Ic which are held as mentioned above are collectively supplied as gradation current Ipix via the four data lines of each of the data line groups DLj to the display pixels EM for the four line segments set to the selection state of each of the scanning lines of the scanning line groups SLi. In addition, in regard to the complete configuration and operation of the data driver will be described later in further detail.

(System Controller)

The system controller 140 operates each driver at predetermined timing by outputting the scanning control signals and data control signals which control the operating state of scanning driver 120 and the data driver 130 mentioned above; generates and outputs the scanning signal Vsel and the gradation currents Ipix; writes in the display data generated by the display signal generation circuit for performing the luminescent operation in each of the display pixels EM; and performs control on the display panel 110 to display predetermined image information based on the video signal.

(Display Signal Generation Circuit)

The display signal generation circuit 150 extracts the luminosity gradation signal component from the video supplied from the exterior of the display device 100 and supplies the data driver 130 as the display data for each one line segment of the display panel 110. Here, when the above-mentioned video signal contains a timing signal component which provides display timing of the image information such as a television broadcasting signal (composite video signal), the display signal generation circuit 150 may have the function which extracts the timing signal component besides the function which extracts the above-mentioned luminosity gradation signal component that is supplied to the system controller 140. In this case, the above-mentioned system controller 140 generates the scanning control signals and data control signals which are supplied to the scanning driver 120, the data driver 130 and a power supply driver 160 based on the timing signal provided from the display signal generation circuit 150.

<<Data Driver Example>>

Next, an example configuration of the data driver applicable to the present invention will be explained in detail.

Figure 3:
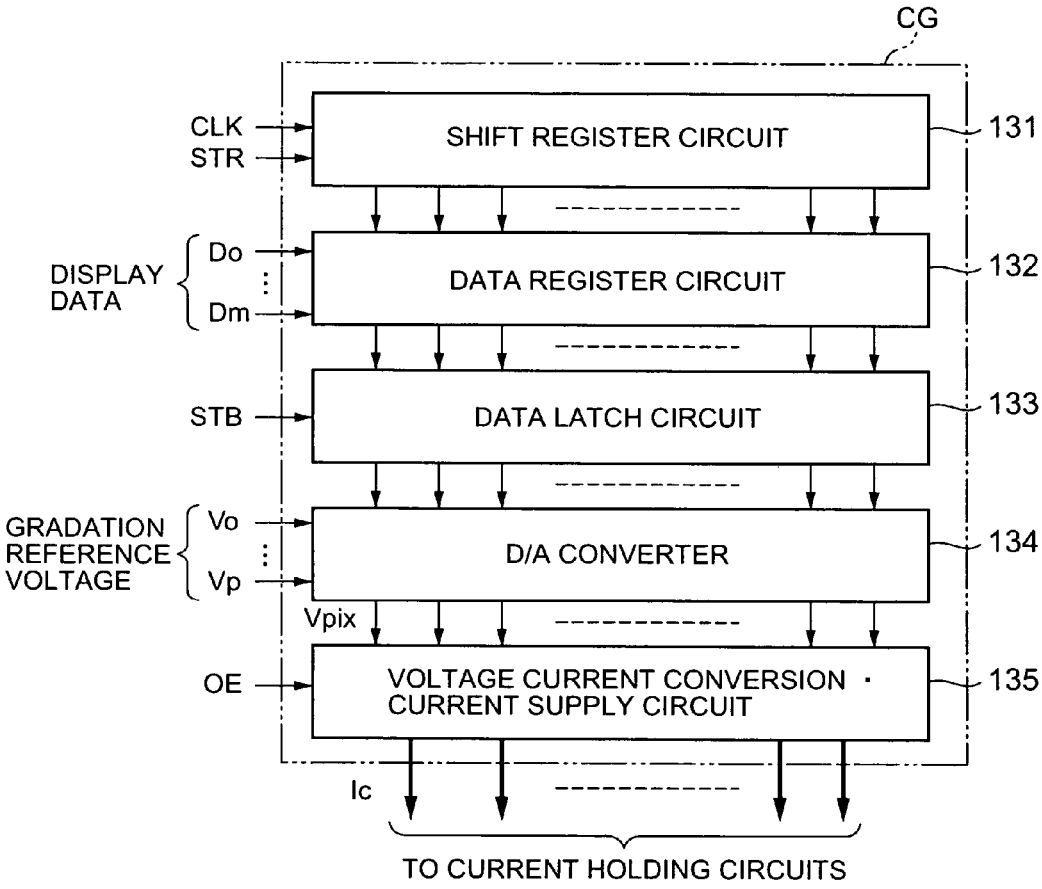
FIG. 3 is a block diagram showing the current generation circuit applicable to the data driver of the display device related to this invention.

FIG. 3 is a block diagram showing the current generation circuit applicable to the data driver of the display device related to this invention.

Figure 4:
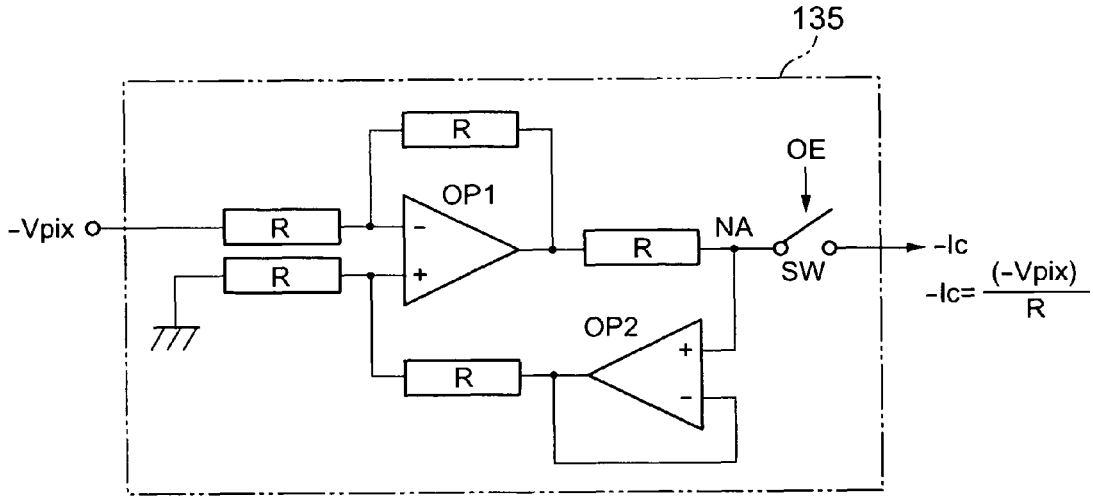
FIG. 4 is a circuit configuration drawing shown an example of the voltage current conversion and the gradation currents drawing-in circuit applicable to the data driver of the display device related to this invention.

FIG. 4 is a circuit configuration drawing shown an example of the voltage current conversion and the gradation currents drawing-in circuit applicable to the data driver of the display device related to this invention.

Figure 5:
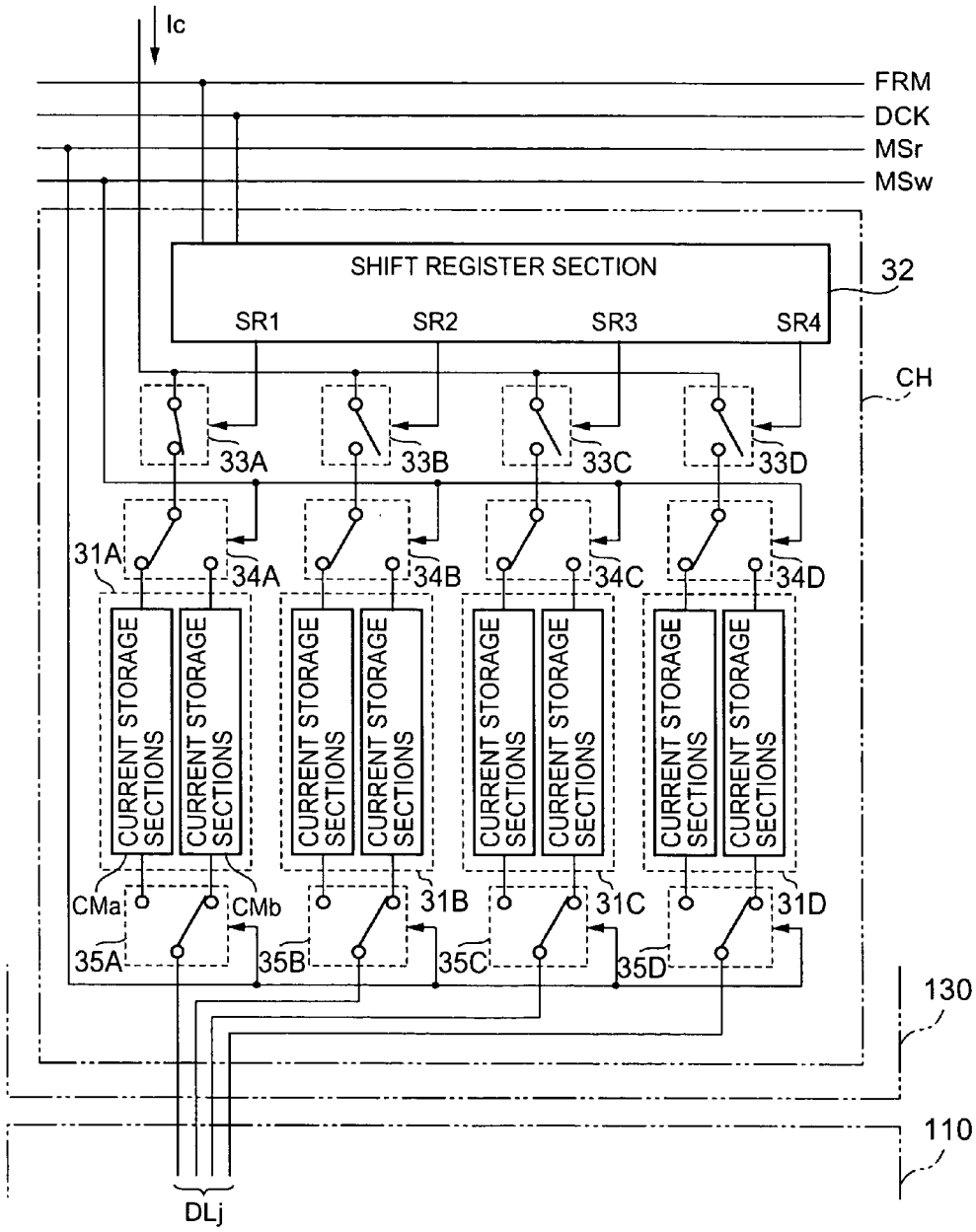
FIG. 5 is an outline block diagram showing an example of the current holding circuits applicable to the data driver of the display device related to this invention.

FIG. 5 is an outline block diagram showing an example of the current holding circuits applicable to the data driver of the display device related to this invention.

The current generation circuit CG, for example as shown in FIG. 3, comprises the shift register circuit 131 which outputs the shift signals while shifting sequentially the sampling start signal STR based on the shift clock signals CLK supplied as the data control signals from the system controller 140;

The data register circuit 132 which takes in sequentially the display data D0~Dm (digitized data) for one line segments supplied from the display signal generation circuit 150 based on the input timing of the above-mentioned shift signals;

The data latch circuit 133 which holds the display data D0~Dm for a one line segments taken in by the data register circuit 132 based on the data latch signals STB;

The D/A converter 134 (Digital-Analog) which converts the display data D0~Dm held in the data latch circuit 133 into predetermined analog signal voltage (gradation voltage Vpix) based on the gradation reference voltage V0~Vp supplied from the power supply circuit; and The voltage current conversion and current supply circuit 135 which generates the signal currents Ic corresponding to the display data converted into analog signal voltage (gradation voltage Vpix) and sequentially supplies each of the current holding circuits CH each of the signal currents Ic of the four data lines of each data line group DLj corresponding to the display pixels EM of the four lines connected to each of the scanning lines SLia, SLib of the scanning line groups SLi of the display panel 110 based on the output enable signals OE supplied from the system controller 140.

In the embodiment, in order to make correspond the pixel driver circuit and the circuit configuration of the light emitting devices provided in the display pixels described later, the signal current of negative polarity is generated as the signal currents Ic. Furthermore, although the signal currents Ic are obtained from a configuration which flows in the direction drawn out from the voltage current conversion and current supply circuit side, this invention is not limited to this. According to the circuit configuration of the pixel driver circuit and the light emitting devices provided in the display pixels, the signal currents Ic of positive polarity may be generated and you may have a configuration which flows in the signal currents Ic.

Here, as a circuit configuration practicable to the voltage current conversion and current supply circuit 135 connected to each data line of each data line group DLj, as shown in FIG. 4 for example, comprises the operational amplifier OP1 by which the gradation voltage (−Vpix) of reverse polarity is inputted to one input terminal (negative input terminal (−)) via the input resistor R, while the reference voltage (ground potential) is inputted to the input terminal (positive input terminal (+)) of the other side via the input resistor R, and the output terminal is connected to one input terminal (−) via the feedback resistor R; the operational amplifier OP2 by which the reference voltage (ground potential) is inputted into the input terminal (+) of the other operational amplifier OP1 via the output resistor R and an input terminal connection of one side is made for the output terminal via the feedback resistor R, while the potential of the contact NA provided in the output terminal of the operational amplifier OP1 via the output resistor R is inputted into one input terminal (+) and the output terminal is connected to the input terminal (−) of the other side; and the switching circuit SW which performs "ON/OFF" operations based on the output enable signals OE supplied from the system controller 140 to the contact NA and controls the supply state of the signal currents Ic to the current holding circuits CH.

According to such a voltage current conversion and current supply circuit 135, the signal currents Ic of negative polarity consisting of −Ic=(−Vpix)/R are generated relative to the gradation voltage (−Vpix) of negative polarity inputted, and supplied sequentially to each data line group DLj to timing based on the output enable signal OE.

The current holding circuits CH, as shown in FIG. 5, are constituted by circuit groups comprising the current storage circuits 31A-31D of which each are composed of a pair of the current storage sections CMa, CMb formed in parallel and a plurality of groups (FIG. 5, four groups) are provided corresponding to each data line of the data line groups DLj, which take in and hold alternately the signal currents Ic supplied from the above-mentioned current generation circuit CG into each of the current storage sections CMa, CMb;

The shift register section 32 which sets the timing to supply sequentially the signal currents Ic corresponding to each data line DLja~DLjd of the data line groups DLj supplied from the current generation circuit CG to each group of the current storage circuits 31A~31D;

The supply control switches 33A~33D which control the supply state (supply/cutoff) of the above-mentioned signal currents Ic to each group of the current storage circuits 31A~31D at predetermined timing based on the timing signals (shift output) SR1~SR4 outputted sequentially from the shift register section 32;

A plurality of input side memory selection switches 34A~34D which perform switching control to supply selectively the above-mentioned signal currents Ic to either of the current storage sections CMa, CMb that form each group of the current storage circuits 31A~31D at timing based on the write-in memory selection signals MSw (inversion signals of the read-out memory selection signals MSr described later) that is the data control signal provided corresponding to each group of the current storage circuits 31A~31D and supplied from the system controller 140.

A plurality of output side memory selection switches 35A~35D which perform switching control to supply the signal currents Ic to each data line DLja~DLjd as gradation current Ipix which are held in either of the current storage sections CMa, CMb that form each group of the current storage circuits 31A~31D at timing based on the read-out memory selection signals MSr that is the data control signal provided corresponding to each group of the current storage circuit 31A~31D and supplied from the system controller 140.

Here, in the shift register section 32, the shift output is generated while shifting sequentially in the specified direction (for example, drawing from left to right direction) based on the shift register reset signal FRM and the shift clock DCK supplied from the system controller 140 which are the data control signals outputted to each of the supply control switches 33A~33D as the timing signals SR1~SR4.

In the data driver 130 which has such a configuration, the signal currents Ic are generated which have a current value according to the luminosity gradation of the light emitting devices in the current generation circuit CG according to the display data (digitized data) produced by the display signal generation circuit 150 based on the video signal. While the signal currents Ic are taken in and held sequentially in one side of the current storage sections (for example, the current storage section CMa) of each of the current storage circuits 31A~31D corresponding to each data line DLja~DLjd of the data line groups DLj, the signal currents Ic held at previous timing in the other side of the current storage sections (for example, the current storage section CMb) are converted into gradation current Ipix and the operation which outputs simultaneously to each data line DLJa~DLjd arranged in the display panel 110 is performed alternately and consecutively.

<<Current Storage Sections>>

Next, an example of the current storage sections applicable to the current holding circuits mentioned above will be explained.

Figure 6:
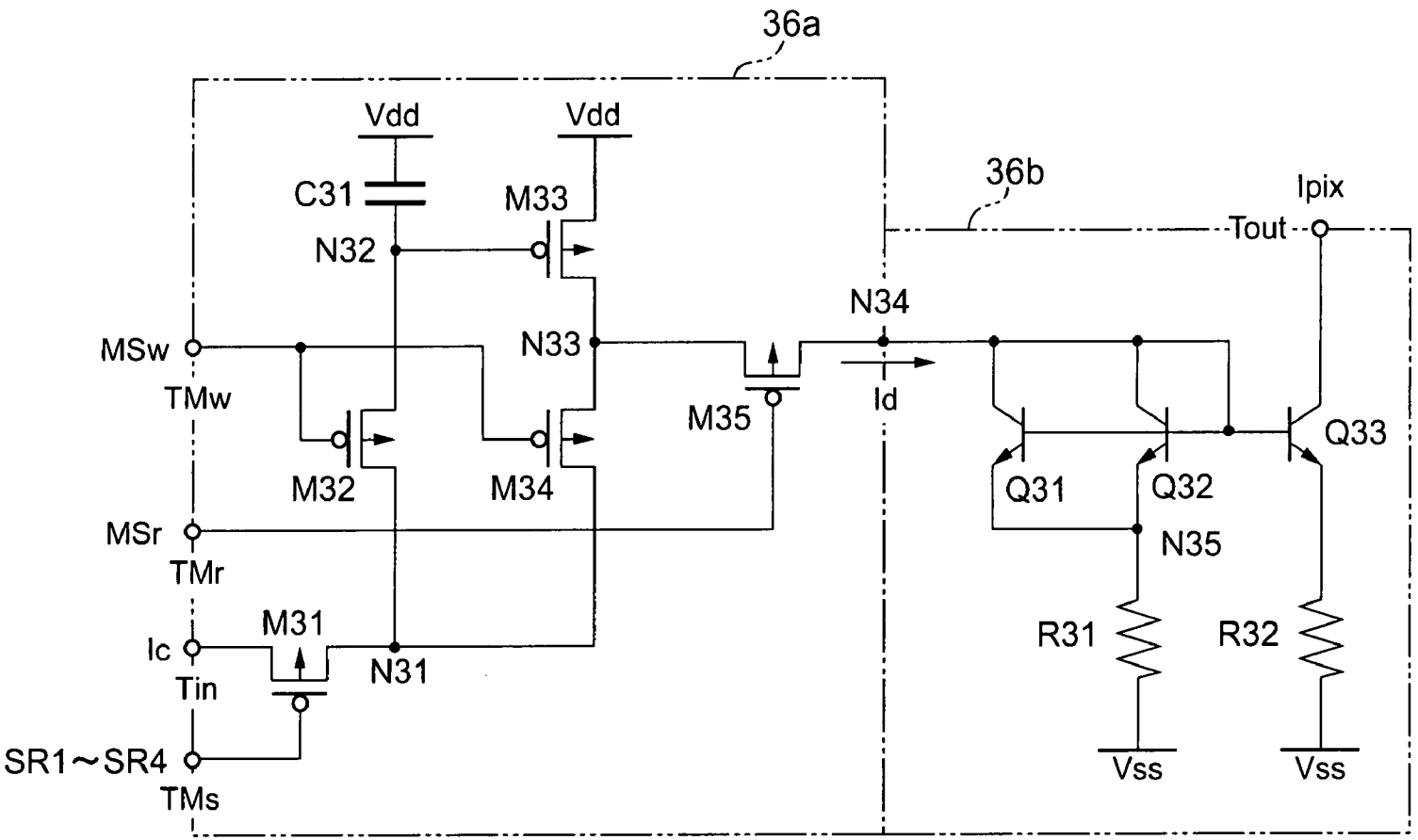
FIG. 6 is a circuit configuration drawing showing an example of the current storage sections applicable to the embodiment.

FIG. 6 is a circuit configuration drawing showing an example of the current storage sections applicable to the embodiment.

Here, the description illustrates one configuration example applicable to the display device related to the present invention, but this circuit configuration is not exclusively limited to this.

In the embodiment, although the configuration which is composed of the current component holding sections and the current mirror sections are shown as the current storage sections, this invention is not limited to this. For example, you may have a circuit configuration which is composed only of the current component holding sections.

The current storage sections CMa, CMb which are constituted in each of the current storage circuits 31A~31D of the current holding circuits CH, for instance as shown in FIG. 6, can apply a circuit configuration which consists of a current component holding section 36*a* which converts and holds the current component of the signal currents Ic outputted from the current generation circuit CG as the voltage component; and a current component mirror circuit 36*b* which sets the current value of the read-out current component after being held in the current component holding section 36*a*.

Here, the current component holding section 36*a* configuration is shown which includes the supply control switches 33A~33D (denoted as "supply control switch 33" generically) mentioned above, the input side memory selection switches 34A~34D (denoted as "input side memory selection switch 34" generically), and the output side memory selection switches 35A~35D (denoted as "output side memory selection switch 35" generically).

As for the current component holding section 36*a*, for example as shown in FIG. 6, has a configuration comprising a PMOS transistor M31 (p-channel type MOS), a PMOS transistor M32, a storage capacitor C31, a PMOS transistor M33, a PMOS transistor M34, and a PMOS transistor M35. The PMOS transistor M31 source and drain are connected between the input terminal Tin to supply the signal currents Ic that are generated by the current generation circuit CG (connects with the output terminal of the current generation circuit CG) and the contact point N31 (hereinafter denoted as "contact" for convenience of explanation), and the gate is connected to the supply control terminal TMs to apply the timing signals SR1~SR4 (denoted as "timing signal SR" generically) that are supplied from the shift register 32;

The PMOS transistor M32 source and drain are connected between the contact N31 and N32, along with the gate connected to the write-in terminal TMw to apply the write-in memory selection signal MSw supplied from the system controller 140;

The storage capacitor C31 is connected between the high electric potential Vdd and contact N32; the PMOS transistor M33 source and drain are connected between the contact N33 and the high electric potential Vdd, along with the gate connected to contact N32;

The PMOS transistor M34 source and drain are connected between the contact N31 and N33, along with the gate connected to the above-mentioned write-in terminal TMw; and The PMOS transistor M35 source and drain are connected between the output contact N34 of the latter current mirror circuit section 36*b* and the contact N33, along with the gate connected to the read-out terminal TMr to apply the read-out terminal selection signals MSr supplied from the system controller 140.

Here, the PMOS transistor M31 performs "ON/OFF" operations based on the timing signals SR (shift output) from the shift register 32 which constitutes the above-mentioned supply control switches 33A~33D.

Furthermore, the PMOS transistors M32 and M34 perform "ON/OFF" operations based on the write-in memory selection signal MSw from the system controller 140 which constitute the input side memory selection switches 34A~34D mentioned above, and the PMOS transistor M35 performs "ON/OFF" operations based on the read-out memory selection signals MSr which constitutes the output side memory selection switches 35A~35D mentioned above. Also, the storage capacitor C31 provided between the high electric potential Vdd and the contact N32 may be parasitic capacitance formed between the gate-source of the PMOS transistor M33.

The circuit configuration shown in FIG. 6 is applicable to both of the pair of current storage sections CMa, CMb which constitute each of the current storage circuits 31A-31D. Thus, whichever of either side of the circuit configuration is shown although each control signal (write-in memory selection signal MSw, read-out memory selection signal) is set as described later. The current storage sections CMa, CMb are controlled to perform a current write-in operation and a current read-out operation in parallel simultaneously as well as set the current write-in state and the current read-out state selectively. Therefore, the current storage sections of other (opposite) sides, in a circuit configuration equivalent to FIG. 6, for example, are set so that the inversion signals of the write-in memory selection signals MSw are applied to the write-in terminal TMw and the inversion signals of the read-out memory selection signal MSr are applied to the read-out terminal TMr.

Furthermore, the current mirror circuit section 36*b*, for example as shown in FIG. 6, has a configuration comprising the NPN transistor Q31, NPN transistor Q32, resistance R31 (resistor), NPN transistor Q33 and resistance R32. The NPN transistors Q31 and Q32 collector and base are connected to the output contact N34 of the above-mentioned current component holding sections 36*a* and the emitter is each other connected to the contact N35; the resistance R31 is connected between the contact N35 and the low electric potential Vss; the NPN transistor Q33 collector is connected to the output terminal Tout (connects with each of the data lines DLja~DLjd) to output the output current (gradation current Ipix), and the base is connected to the output contact N34 of the above-mentioned current component holding section 36*a*; and the resistance R32 is connected between the emitter of the NPN transistor Q33 and the low electric potential supply Vss.

Here, the output current (gradation current Ipix) is outputted from the above-mentioned current component holding section 36*a* and set so that it has the current value corresponding to the predetermined current ratio provided by the current mirror circuit configuration relative to the current value of the control current Id inputted via the output contact N34.

In addition, this embodiment is constituted so that the current component flows in the direction drawn in the current holding circuit CH direction from each of the data lines DLja~DLjd by supplying the output current of negative polarity to the output terminal Tout, specifically, by setting so that the gradation current Ipix flows in the low electric potential Vss direction from the output terminal Tout side.

Also, the current storage sections CMa, CMb shown in this embodiment are set so that the current value of the control current Id may be reduced by a predetermined ratio by the current mirror circuit section 36*b* and the current value of the output current (gradation current Ipix) can be regulated by setting the current value of the control current Id outputted from the current component holding section 36*a* greater than the current value of the output current generated by the current mirror circuit section 36*b*. Since the current value managed within the current component holding sections 36*a* can be set greater than the current value of the gradation current Ipix, the processing speed related to the current write-in operation and current read-out operation in the current component holding sections 36*a* can be raised.

<<Operation of the Current Storage Sections>>

Next, the operation of the current storage sections which have a configuration mentioned above will be explained.

Figure 7A:
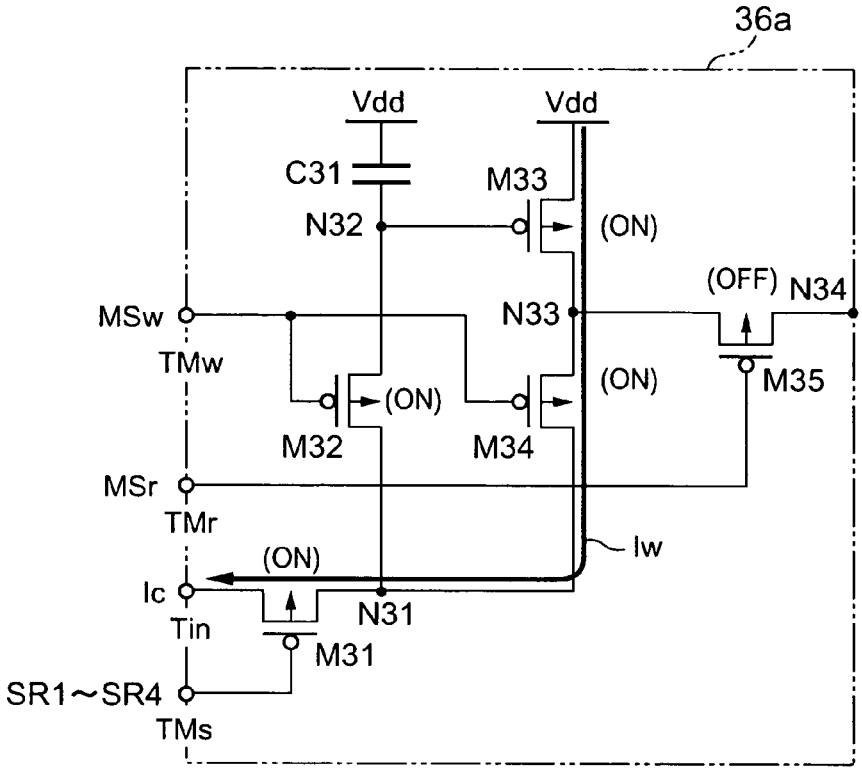
FIGS. 7A and 7B are conceptual diagrams showing the basic operation of the current storage sections applicable to the embodiment.
Figure 7B:
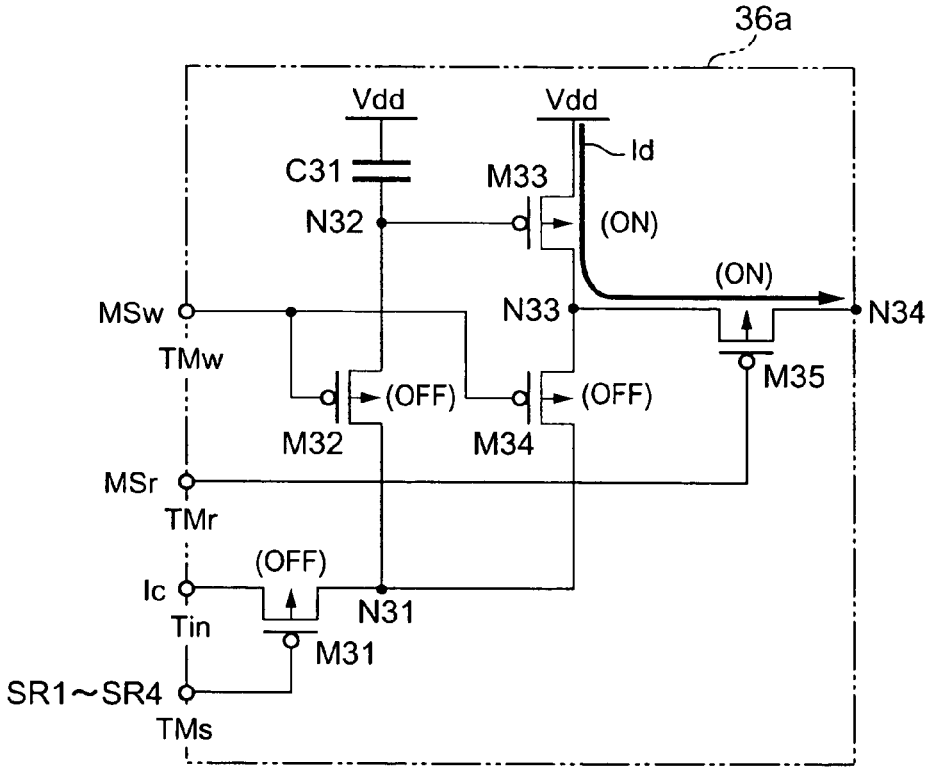

FIGS. 7A and 7B are conceptual diagrams showing the basic operation of the current storage sections applicable to the embodiment.

The operation of the current storage sections related to this embodiment is set so that sequential repetitive execution can be performed of the current write-in operation which takes in the signal currents Ic and held (stored) as the voltage component at predetermined timing that does not generate time overlaps with each other in relation to the light generation drive cycles of the display pixels that constitute the display panel; and the current read-out operation which outputs the gradation current Ipix that has a predetermined current value based on the held voltage component.

Furthermore, regarding the pair of current storage sections provided in parallel in the current storage circuits, when a current write-in operation is performed in one side of the current storage sections, it is controlled to perform a current read-out operation in the other side of the current storage sections in parallel simultaneously within the period. Essentially, while performing current write-in operations continuously, current read-out operations are performed continuously in parallel by the single current storage circuits.

(Current Write-In Operation)

Initially in the current write-in operation, as shown in FIG. 7A, the PMOS transistor M35 in the capacity of an output side memory selection switch 35 performs an "OFF" operation by applying a high-level read-out memory selection signal MSr via the read-out terminal TMr from the system controller 140.

In this state, while supplying the signal currents Ic which has the current component of negative polarity according to the display data D0~Dm via the input terminal Tin from the current generation circuit 36*a*, the PMOS transistors M32 and M34 in the capacity of an input side memory selection switch 34 perform an "ON" operation by applying a low-level write-in memory selection signal MSw at predetermined timing via the write-in terminal TMw from the system controller 140.

In this current write-in operation, the PMOS transistor M31 in the capacity of a supply control switch 33 performs an "ON" operation by applying a low-level timing signal SR via the supply control terminal TMs from the shift register 32.

Accordingly, the gate terminal of the PMOS transistor M33 and one end of the storage capacitor C31, specifically, the contact N32, when the low-level voltage level according to the signal currents Ic which has the same negative polarity is applied and an electric potential difference occurs between the high electric potential Vdd and the contact N32 (that is, between the gate-source of the PMOS transistor M33), the PMOS transistor M33 performs an "ON" operation and flows so that the write-in currents Iw equivalent to the signal currents Ic may be drawn in the direction of the input terminal Tin via the PMOS transistors M33, M34 and M31 from the high electric potential Vdd.

At this time, the storage capacitor C31 stores the electric charge corresponding to the electric potential difference generated between the high electric potential Vdd and the contact N32 (that is, between the gate-source of the PMOS transistor M33) and is held as the voltage component.

Here, the high-level write-in memory selection signal MSw is applied via the write-in terminal TMw from the system controller 140 by the termination of the current write-in operation, the PMOS transistors M32 and M34 perform an "OFF" operation and the electric charge (voltage component) stored in the storage capacitor C31 is held after the drawing in of the above-mentioned write-in currents Iw is suspended (stopped).

(Current Read-Out Operation)

Next, in the current read-out operation which outputs the gradation currents after the current write-in operation terminates, as shown in FIG. 7B, the PMOS transistor M35 performs an "ON" operation by applying the low-level read-out memory selection signal MSr via the read-out terminal TMr from the system controller 140.

At this time, as mentioned above, the PMOS transistors M32 and M34 perform an "OFF" operation by applying a high-level write-in memory selection signal MSw via the write-in terminal TMw. In this current read-out operation, the PMOS transistor M31 performs an "OFF" operation by applying a high-level timing signal SR via the supply control terminal TMs from the shift register 32.

Here by the voltage component held in the storage capacitor C31, since an electric potential difference equivalent to the time of the current write-in operation has occurred between the gate-source of the PMOS transistor M33, the control currents Id which have a current value equivalent to the above-mentioned write-in currents Iw(≈signal currents Ic) flow in the direction of the output contact N34 (current mirror circuit section 36*b*) via PMOS transistors M33 and M35 from the high electric potential Vdd.

Accordingly, the control currents Id inputted into the current mirror circuit section 36*b* are converted into the gradation currents Ipix which have a current value according to the predetermined current ratio specified by the current mirror circuit configuration and are supplied to the display pixels EM as the load via the output terminal Tout and each of the data lines DLja~Dljd. Here, the gradation current Ipix at the termination of the current read-out operation, by applying a high-level read-out memory selection signal MSr via the read-out terminal Tmr from the system controller 140, the PMOS transistor M35 performs an "OFF" operation and supply to the current mirror circuit section 36*b* is suspended.

<<The Drive Method of the Display Device>>

Next, the drive method in the display device which has the configuration mentioned above is explained in detail.

Figure 8:
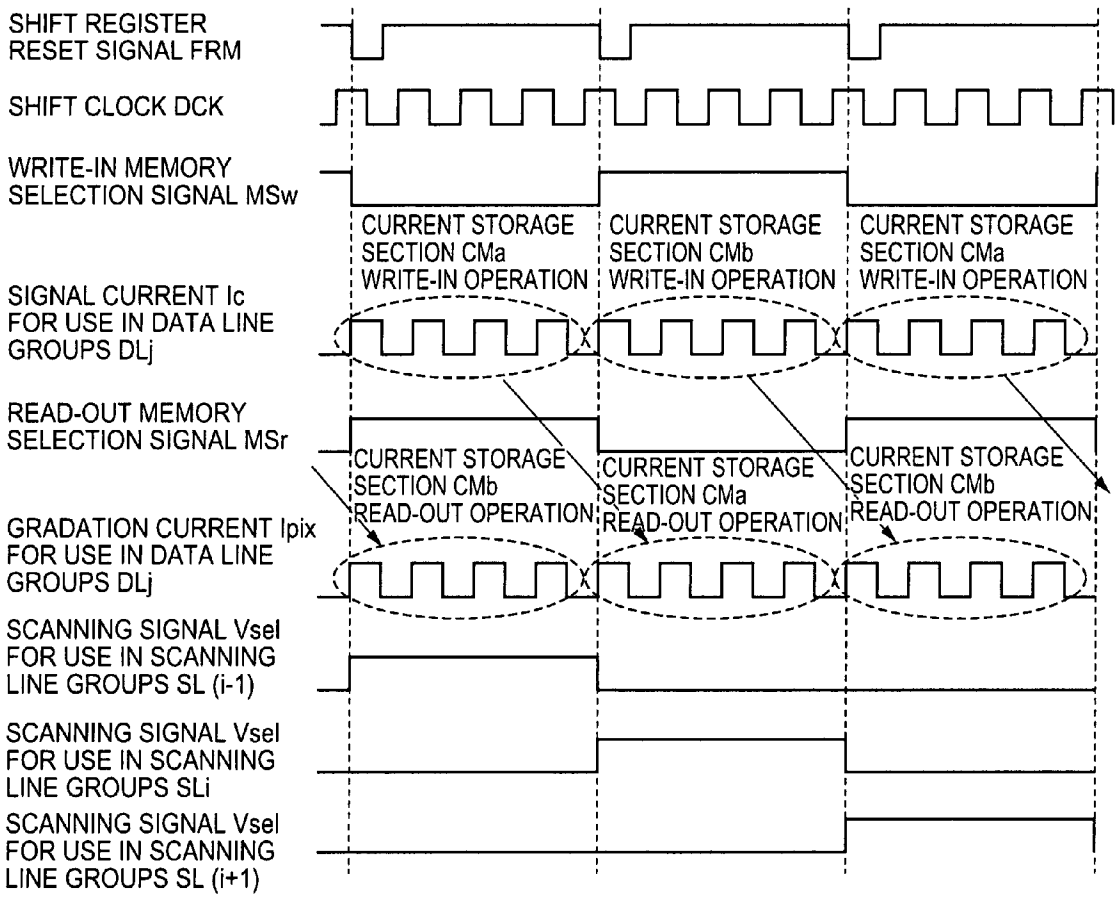
FIG. 8 is a timing chart explaining the drive method in the display device related to the embodiment.

FIG. 8 is a timing chart explaining the drive method in the display device related to the embodiment.

In addition, explanation will refer to each configuration of the display device mentioned above.

In the display device which has the configuration mentioned above, first, the luminosity gradation signal component is extracted from the video signal supplied from the exterior of the display signal generation circuit 150. The display data which is composed of the digitized data for performing the luminescent operation of each display pixel EM which constitutes the display panel 110 by predetermined luminosity gradation is extracted and the data driver 130 is supplied sequentially as the serial data of each line of the display panel 110.

The display data (digitized data) supplied to the data driver 130 within the current generation circuit CG at timing based on the data control signal supplied from the system controller 140, converted into signal currents Ic according to the above-mentioned display data, and outputted to each of the current holding circuits Ch provided corresponding to each of the data line groups DLj arranged in the display panel 110.

Here, the signal currents Ic outputted to the current holding circuits CH from the current generation circuit CG is set as the configuration corresponding to each column of the data line groups DLj in the display panel 110, and configured so that each of the signal currents Ic corresponding to the display pixels of each line (four lines) connected to each of the data lines DLja~DLjd which constitute the data line groups Dlj, are outputted in time series sequences.

In the current holding circuits CH, as shown in FIG. 8, the above-mentioned signal currents Ic corresponding to each of the display pixels EM of a plurality of lines corresponding to each column of the data line groups is take in sequentially. The input timing of the supply control signals SR1~SR4 are then outputted from the shift register 32. When any of the supply control switches 33A~33D performs an "ON" operation, the current storage circuits (for example, current storage circuit 31A) are selected which accomplish the current write-in operation. Further, based on the write-in memory selection signal MSw supplied from the system controller 140, the input side memory selection switch 34A-34D switches (flip-flops) and is controlled. After the above-mentioned selection is made, one of the current storage sections (for example, current storage section CMa) is selected among the pair of current storage sections CMa, CMb which constitute the current storage circuit 36*a*.

Accordingly, among the signal currents Ic (signal currents Ic for the data line groups DLj shown in FIG. 8) supplied to the current holding circuits CH from the current generation circuit CG connected with the data lines DLja corresponding to the current storage circuits 31A, the current component corresponding to the display pixels of specified lines is supplied and held at specified timing in the current storage sections CMa. In such a current write-in operation, the current component of the display pixels EM for a plurality of lines (four lines) connected to the specified columns of the data line groups DLj which the appropriate current holding circuits CH are connected is held sequentially in each of the current storage sections CMa by selecting sequentially and executing to each of the current storage circuits 31A~31D provided in the current holding circuits CH to the input timing of the supply control signals SR1~SR4 outputted from the shift register 32.

Therefore, by holding sequentially the signal currents Ic outputted for each of the data line groups DLj of each column from the current generation circuit CG to the plurality of current storage circuits 31A~31D provided in each of the current holding circuits CH, the current component corresponding to the display pixels EM for a plurality of lines (four lines) connected to each column of the data line groups DLj in the display panel 110 is held (stored) in parallel at each of the current storage circuits 31A~31D of each of the current holding circuits CH.

Additionally, in the operation period when the current write-in operation is performed, as shown in FIG. 8 and as explained in the operation of the current storage sections mentioned above, by supplying the read-out memory selection signals MSr which function as the inversion signals of the above-mentioned write-in memory selection signals MSw from the system controller 140 to each of the current holding circuits CH, the output side memory selection switches 35A~35D switch (flip-flops) and are controlled. The current storage sections (for example, current storage section CMb) of the other side which is not selected in the above-mentioned current write-in operation is then selected from among the pair of current storage sections CMa, CMb which constitute each of the current storage circuits 31A~31D.

Accordingly, in advance of the switchover period to the current write-in operation, the current component is written and held in each of the current storage sections CMb as gradation current Ipix (gradation current Ipix for the data line groups DLj shown in FIG. 8) and outputted at the same timing (current read-out operation) to each data line DLja~DLjd which constitute each column of the data line groups DLj from each current holding section CH.

Therefore, the gradation current Ipix outputs via each column of the data line groups DLj from the current holding circuits CH and by applying the scanning signal Vsel of the selection level to the scanning line groups SL (i−1) from the specified shift blocks SB (i−1) of the scanning driver 120 as shown in FIG. 8 to the timing based on the scanning control signals supplied from the system controller 140, all of the selection transistors Trsel connected to each of the scanning lines SLia, SLib which constitute the scanning line groups SL (i−1) perform an "ON" operation. The gradation current Ipix is taken in and supplied via each of the above-mentioned data lines DLja~DLjd to the display pixels EM of the plurality of lines (four lines) connected to each of the scanning lines SLia, SLib and each of the display pixel EM performs luminescent operation (light generation) by predetermined luminosity gradation based on this gradation current Ipix.

Next, after applying the shift register reset signal FRM to the shift register section 32 from the system controller 140 and resetting the shift register 32, while performing a series of current write-in operations mentioned above relating to the other side of the current storage sections CMb of each of the current storage circuits 31A~31D, current read-out operations are performed in parallel simultaneously to the side of the current storage sections CMa of each of the current storage circuits 31A~31D.

Consequently, as shown in FIG. 8, the signal currents Ic according to the display data generated by the current generation circuit CG is taken in sequentially to each column of the current holding circuits CH and held sequentially in the other side of the current storage sections CMb of each of the current storage circuits 31A~31D set to the selection state based on the input timing and the write-in memory selection signals MSw of the supply control signals SR1~SR4.

Also, at this time by supplying the read-out memory selection signals MSr functioning as the inversion signals of the above-mentioned write-in memory selection signals MSw to each of the current holding circuits CH, the current component held by the above-mentioned current write-in operation is read to the current storage sections CMa on one side of each of the current storage circuits 31A~31D and outputted simultaneously to each column of the data line group DLj as gradation current Ipix.

As a result, by repeating alternately the controls which perform the current write-in operations and current read-out operations in parallel simultaneously each predetermined operation period to the pair of current storage sections CMa, CMb provided in each of the current storage circuits 31A~31D, basically, the signal currents Ic corresponding to the display data and outputted from the current generation circuit CG are taken in and held in the current holding sections continuously and the operation to supply simultaneously the display pixels of the plurality of lines with gradation currents Ipix are performed.

Therefore, in this embodiment, by applying a single scanning signal from the scanning driver of the display panel by which two-dimensional array of the plurality of display pixels is performed, the present invention is constituted so that the display pixels for the plurality of lines (four lines in the configuration shown in FIG. 2) may be collectively set to the selection state. Furthermore, with the data driver, the present invention takes in and holds sequentially the display data corresponding to the display pixels of the specified plurality of lines which is constituted so that collectively the gradation currents can be supplied in one scanning period.

Consequently, since the number of scanning lines driven to single scanning timing, specifically the line count of the display pixels which are selected simultaneously and driven, can be increased a plurality of times (two or more folds), if the period to scan all the scanning lines (one screen) is made the same as compared with conventional drive methods which select sequentially and apply one scanning signal for each of the scanning lines, the application period of one scanning signal applied from the scanning driver can be set a plurality of times (By the configuration shown in FIG. 2, fourfold). As a result, the write-in time to the display pixels can be set a plurality of times in contrast with cases of conventional drive methods. In view of this, for example, even if it is the case where the gradation current written in the display pixels has a low current value based on display data of low gradation, the wiring capacitor of the data lines can be fully charged to predetermined voltage.

Thus, according to the configuration of this embodiment, since the write-in time of the display data to each of the display pixels can be acquired sufficiently longer, when the display panel is enlarged or high resolution is performed, or even at times of low gradation the write-in deficiency of the display data can be cancelled out (neutralized). In addition, the luminescent operation of each of the display pixels can be performed by the proper luminosity gradation according to the display data, display non-uniformity, such as the luminosity inclination generated within the display panel, can be diminished substantially, as well as marked improvement in the display image quality can attained.

Here, the advantages of the configuration in this embodiment will be explained based on the write-in characteristics of the display data.

Figure 9:
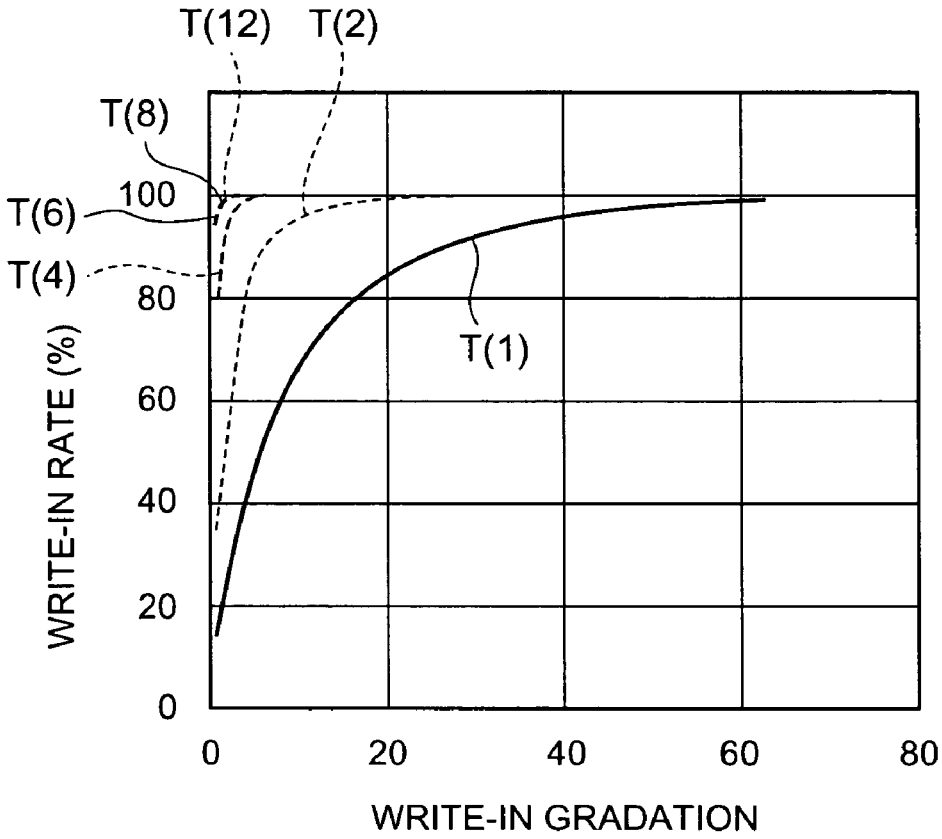
FIG. 9 is the simulation results for explaining the write-in characteristics of the display data in the display device related to the embodiment.

FIG. 9 is the simulation results for explaining the write-in characteristics of the display data in the display device related to the embodiment.

Figure 16:
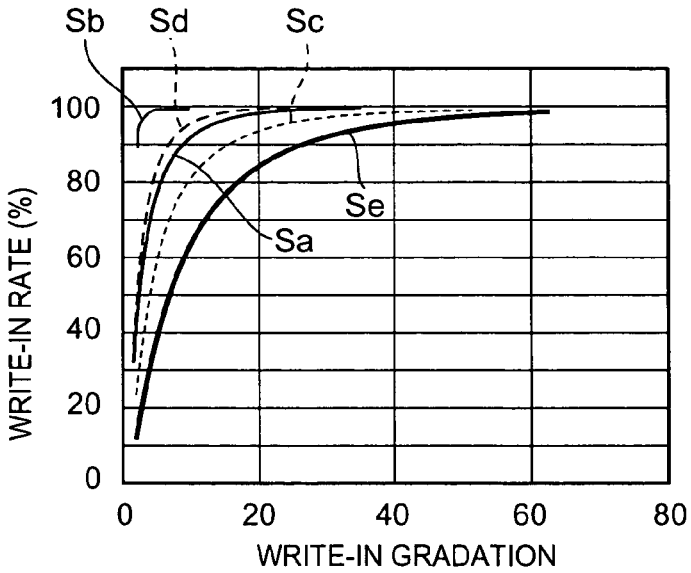
FIG. 16 is the simulation results for illustrating the influence of the write-in characteristics on the display data in various types of display panels.
Figure 17:
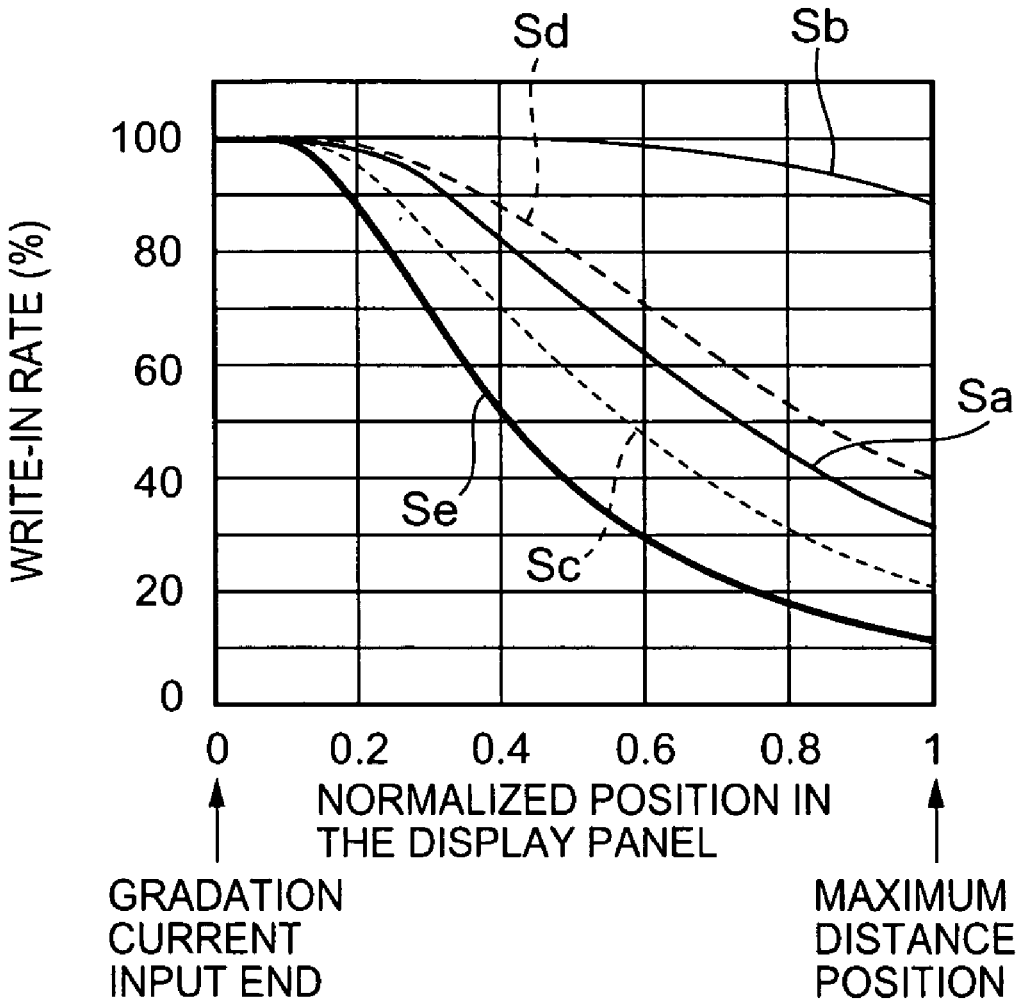
FIG. 17 is the simulation results for illustrating the influence of the write-in characteristics on the wiring capacitor in various types of display panels.

Here, the simulation results illustrated in FIG. 9 show the change of the write-in characteristic at the time of a 37' (screen size of 37 inches) display panel model (Corresponding to the display panel Se in FIG. 16) which has 1365 horizontal pixels, 768 vertical pixels and the wiring capacitor of 19.9 pF (power factor) of the data lines and changes write-in time sequentially. Each characteristic curve T(1)~T(12) shows the correlation of the write-in rate of the proper display data versus the gradation of the display data when lengthening the write time of the normal state (22 μsec-22 microseconds) relative to twofold (44 μsec (2×)), fourfold (88 μsec (4×)), sixfold (132 μsec (8×)) . . . twelvefold (264 μsec (12×)). As shown in FIG. 9, by making the write time fourfold or more as shown in T(4), in general the write time of the display data of low gradation improves to the extent that the write rate becomes longer. Thus, even if it is the case where the display data of low gradation close to minimum gradation is written in, it proves that generally 100% of the write rate is gained.

In the embodiment mentioned above, as the display pixels for the plurality of lines (for example, four lines) are driven and set to the selection state by a single scanning signal, the write time can be set to a plurality of times (for example, fourfold) and the write time can be made longer than cases of conventional drive methods. Thereby, as shown in FIG. 9, even if it is the case where the display data of relatively low gradation is written in the display pixels, the write rate approximated to 100% in general is achievable. Consequently, improvement of the display image quality can be attained toward enlargement and higher resolution of the display panel.

<<An Example Configuration of the Display Pixels>>

Next, an example of the configuration of an illustrative circuit applicable to the display pixels mentioned above will be explained with reference to the drawings.

Figure 10:
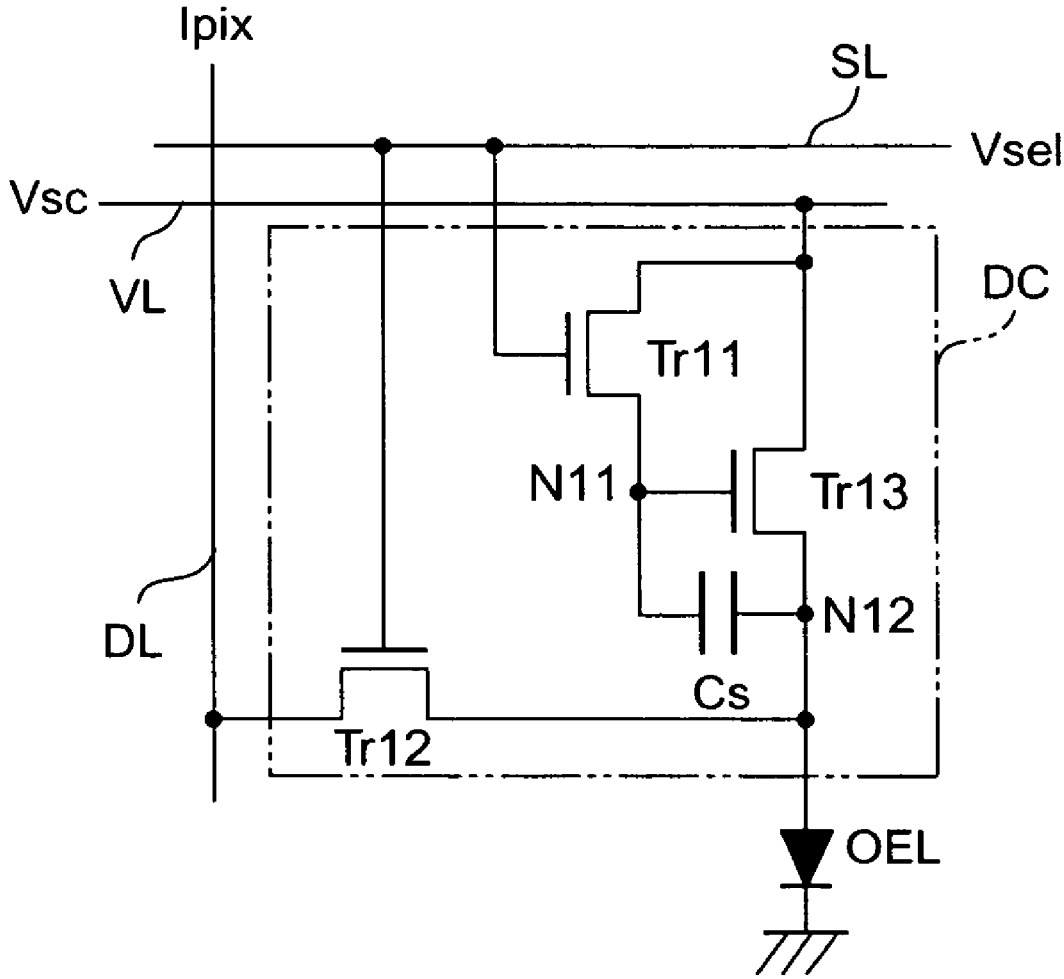
FIG. 10 is a circuit configuration diagram showing an example of an illustrative circuit of the display pixels applicable to the display device related to this invention.
Figure 11A:
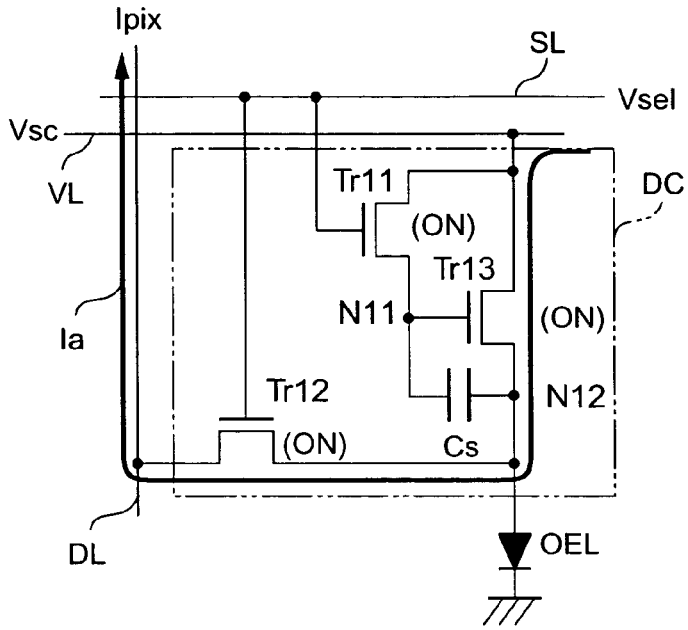
FIGS. 11A and 11B are operational conceptual diagrams for explaining the drive control operation of the pixel driver circuit related to the embodiment.
Figure 11B:
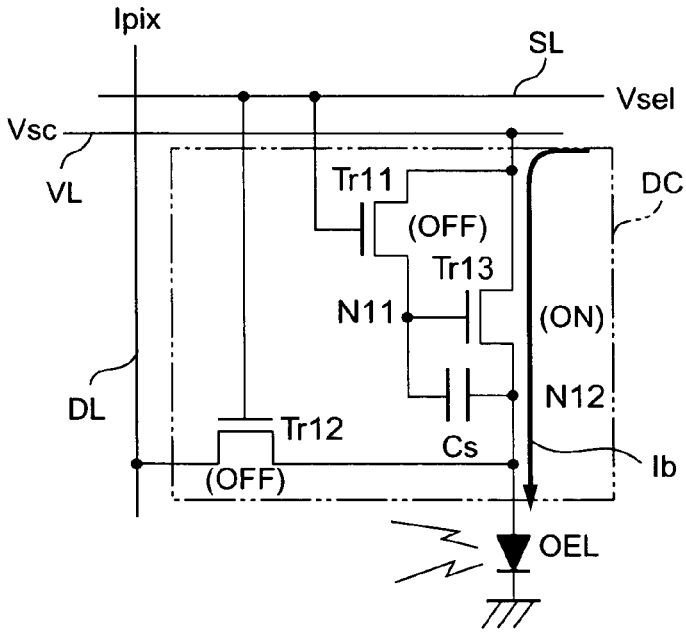

FIG. 10 is a circuit configuration diagram showing an example of an illustrative circuit of the display pixels applicable to the display device related to this invention;

FIGS. 11A and 11B are operational conceptual diagrams for explaining the drive control operation of the pixel driver circuit related to the embodiment.

Figure 12:
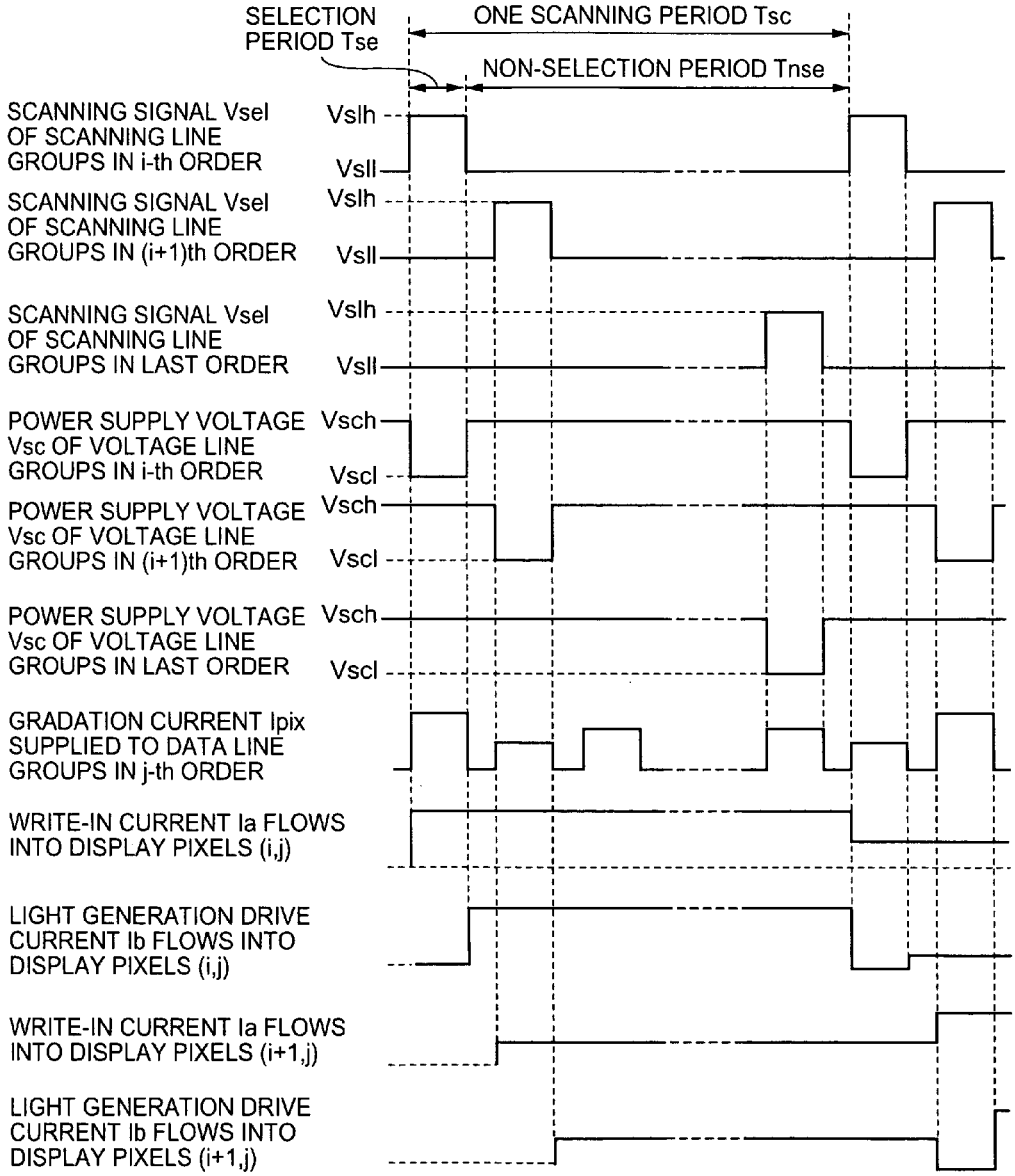
FIG. 12 is a timing chart showing the display drive operation of the display device as applied to the display pixels related to the embodiment.

FIG. 12 is a timing chart showing the display drive operation of the display device as applied to the display pixels related to the embodiment.

Figure 13:
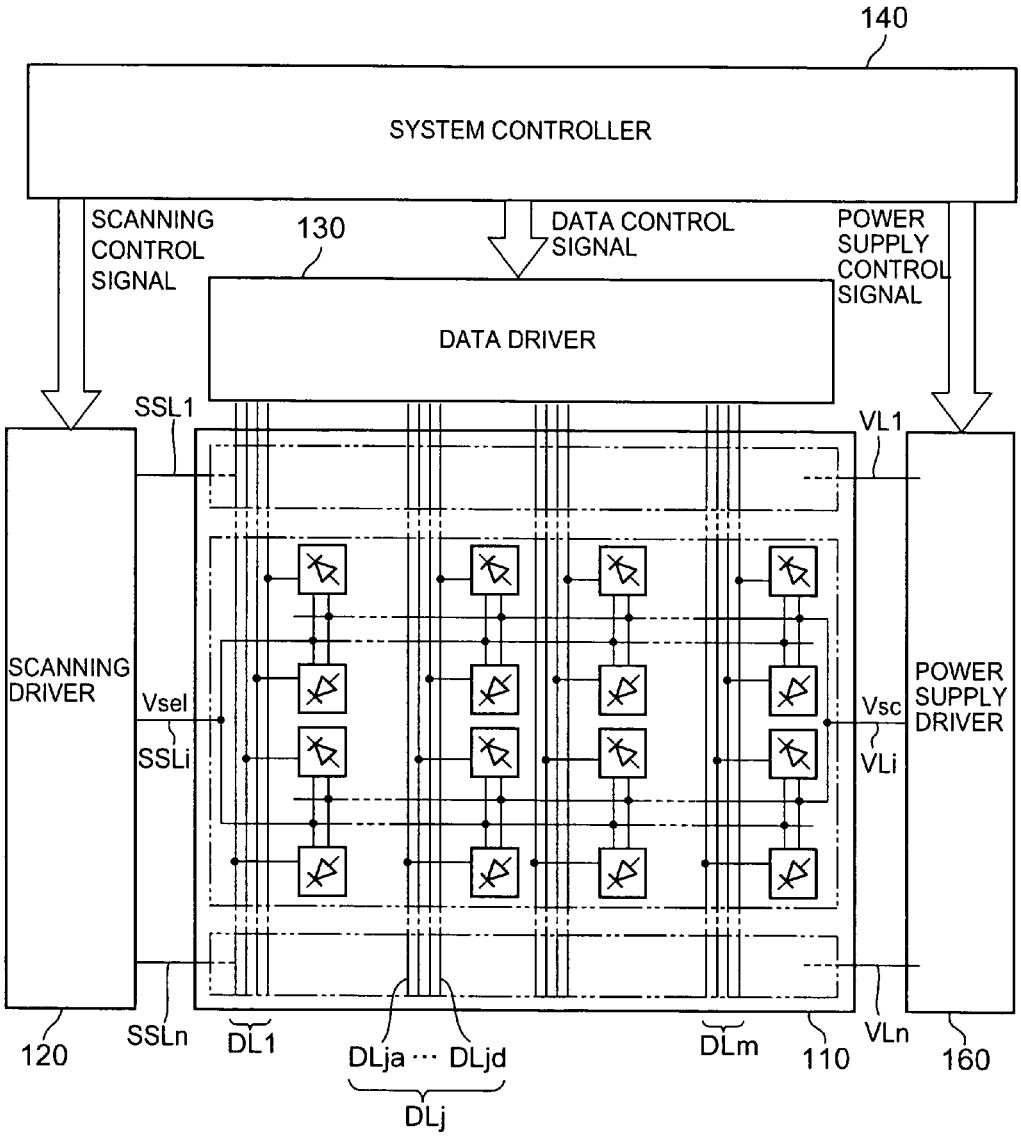
FIG. 13 is an outline block diagram showing an example of the configuration of the display device as applied to the display pixels related to the embodiment.

FIG. 13 is an outline block diagram showing an example of the configuration of the display device as applied to the display pixels related to the embodiment.

The display pixels related to this embodiment are equivalent to the selection transistor Trsel and the display pixels EM shown in FIG. 2. As shown in FIG. 10, briefly, the circuit configuration has a pixel driver circuit DC (light generation driver circuit) which is set to the selection state based on the scanning signal Vsel applied from the scanning driver 120 mentioned above, takes in gradation currents Ipix supplied from the data driver 130 in this selection state, and flows the light generation drive currents according to this gradation currents Ipix to the light emitting devices; and the current control type light emitting devices which perform luminescent operation by predetermined luminosity gradation based on light generation drive currents supplied from the pixel driver circuit DC.

The pixel driver circuit DC, for example as shown in FIG. 10, has a configuration comprising the n-channel type Thin-Film Transistor (TFT) Tr11 (hereinafter denoted as "Nch transistor"), the Nch transistor Tr12, the Nch transistor Tr13, and the capacitor CS. The Nch transistor Tr11 is each other connected with the gate terminal to the scanning lines SL, the source terminal to the supply lines VL and the drain terminal to the contact N11. The Nch transistor Tr12 gate terminal is connected to the supply lines VL, along with the source terminal and the drain terminal each other connected to the data lines DL and the contact N12. The Nch transistor Tr13 gate terminal is connected to the contact N11, along with the source terminal and the drain terminal each other connected to the contact N12 and the supply lines VL. The capacitor Cs is connected between the contact N11 and the contact N12. Furthermore, the organic EL devices OEL are each other connected with the anode terminal to the contact N12 and the cathode terminal to ground potential.

Here, the capacitor Cs can be parasitic capacitance provided between the gate-source of the Nch transistor Tr13. Also, the Nch transistor Tr12 is equivalent to the selection transistor Trsel in FIG. 2.

The light generation drive control of the light emitting devices (organic EL devices OEL) in the pixel driver circuit DC which has such a configuration, for example as shown in FIG. 12, performs by setting (Tsc=Tse+Tnse). One scanning period Tsc denotes one cycle. The selection period Tse (write-in operation period) selects the display pixels of the plurality of lines connected to the specified scanning line groups SLi, writes in the gradation current Ipix corresponding to the display data and is held as the voltage component within this one scanning period Tsc. The non-selection period Tnse (luminescent operation period) writes in the selection period Tse, supplies the light generation drive according to the above-mentioned display data to the organic EL devices OEL based on the voltage component and performs the luminescent operation by predetermined luminosity gradation. Here, the selection period Tse is set for every one of the scanning line groups SLi connected to the plurality of display pixels EM so that a time period overlap does not occur with one another.

(Selection Period: Write-In Operation Period)

That is, in the selection period Tse of the display pixels, as shown in FIG. 12, first, while the high-level scanning signal Vsel (Vslh) is applied to the specified scanning line groups SLi from the scanning driver 120 and the display pixels of the plurality of lines are collectively set to the selection state, the low-level power supply voltage Vscl is applied to the supply lines VL of the display pixels of the appropriate plurality of lines.

Also, synchronizing with this timing, the gradation current (−Ipix) of the negative polarity corresponding to the display pixels of the appropriate plurality of lines is supplied to each data line group DLj from the data driver 130.

Accordingly, the Nch transistors Tr11 and Tr12 which constitute the pixel driver circuit DC perform an "ON" operation. As the low-level power supply voltage Vsc (Vscl) is applied to the contact N11 (specifically, the gate terminal of the Nch transistor Tr13 and one end of the capacitor Cs) that performs the operation which draws the gradation current (−Ipix) of negative polarity via the data lines DL, the voltage level of the low electric potential from the low-level power supply voltage Vscl is applied to the contact N12, namely the source terminal of the Nch transistor Tr13 and the other end of the capacitor Cs.

Thus, when an electric potential difference occurs between contact N11 and N12 (between gate-source of the Nch transistor Tr13), the Nch transistor Tr13 performs an "ON" operation. As shown in FIG. 11A, the write-in current Ia corresponding to the gradation current Ipix flows from the supply lines VL to the data driver 130 via the Nch transistor Tr13, the contact N12, the Nch transistor Tr12 and the data lines DL. Accordingly, the capacitor Cs (charge) stores the electric charge corresponding to the electric potential difference generated between the contacts N11 and N12 (between the gate-source of Nch transistor Tr13) and the write-in operation which holds it as the voltage component (charge voltage) is performed. Moreover, the power supply voltage Vscl which has the voltage level lower than ground potential is applied to the supply lines VL and further controlled so that the write-in current Ia flows in the direction of the data lines DL. Because the electric potential applied to the anode terminal (contact N12) of the organic EL devices OEL becomes lower than the electric potential (ground potential) of the cathode terminal, reverse-bias is applied to the organic EL devices OEL, drive current does not flow to the organic EL devices OEL and the luminescent operation is not performed.

(Non-Selection Period: Luminescent Operation Period)

Next, in the non-selection period Tnse after termination of the selection period Tse, as shown in FIG. 12, while the low-level scanning signal Vsel (Vsll) is applied to the specified scanning line groups SLi from the scanning driver 120 and the display pixels of the plurality of lines are set to the non-selection state, the high-level power supply voltage Vsch is applied to the supply lines VL of the display pixels of the appropriate plurality of lines. Also, synchronizing with this timing, the drawing in operation of the gradation current Ipix by the data driver 130 is suspended.

Accordingly, the Nch transistors Tr11 and Tr12 which constitute the pixel driver circuit DC perform an "OFF" operation. While applying the power supply voltage Vsc to the contact N11 through which it passes, namely, the Nch transistor Tr13 and one end of capacitor Cs, is blocked out. Because application of the voltage level resulting from the drawing in operation of the gradation current Ipix by the data driver 130 to the contact N12 (accordingly, the source terminal of Nch transistor Tr13 and the other end of capacitor Cs) is blocked out, the capacitor holds the electric charge (voltage component) stored in the selection period mentioned above.

Thus, when capacitor Cs holds the electric charge (voltage component) stored by the write-in operation of the selection period, the electric potential difference between contacts N11 and N12 (between the gate-source of Nch transistor Tr13) is held, the Nch transistor Tr13 maintains an "ON" state. Also, the power supply voltage Vsc (Vsch) which has a voltage level higher than ground potential is applied to the supply lines VL, the electric potential applied to the anode terminal (contact N12) of the organic EL devices OEL becomes higher than the electric potential (ground potential) of the cathode terminal.

Therefore, as shown in FIG. 11B, predetermined light generation drive current Ib flows into the organic EL devices OEL in the direction of forward-bias via Nch transistor Tr13 and the contact N12 from the supply lines VL and the organic EL devices OEL emit light.

Here, because the voltage component (charge voltage) held by capacitor Cs is equivalent to the electric potential difference in the case of making it flow down the write-in current Ia corresponding to the gradation current Ipix in the Nch transistor Tr13, the light generation drive current Ib which flows down to the organic EL devices OEL will have the current value equivalent to the above-mentioned write-in current Ia. Accordingly, in the non-selection period Tnse after the selection period Tse, based on the voltage component corresponding to the display data (gradation current Ipix) written in the selection period Tse, via the Nch transistor Tr13, drive current is supplied continuously and the organic EL devices OEL continue the operation which emits light by the luminosity gradation corresponding to the display data.

Also, as shown in FIG. 12, by performing sequentially a series of operations mentioned above repeatedly and sequentially to all the scanning line groups SLi which constitute the display panel 110, the display data for one screen of the display panel is written in, light is emitted by the predetermined luminosity gradation, and the desired image information is displayed.

In regard to the Nch transistors Tr11~Tr13 applicable to the pixel driver circuit DC related to this embodiment, though not limited especially, as the Nch transistors Tr11~Tr13 can all be constituted from n-channel type Thin-Film Transistors (TFTs), n-channel type amorphous silicon TFTs are satisfactorily applicable. In that case, the already established manufacturing technology can be applied and a pixel driver circuit which has stabilized operating characteristics can be produced relatively cheaply.

Here, as a configuration which applies the predetermined power supply voltage Vcs to the supply lines VL in the pixel driver circuit DC related to this embodiment, for example as shown in FIG. 13, comprises the supply driver 160 which is connected to the supply line groups VLi which are composed of a plurality of supply lines VL arranged in parallel with each of the scanning lines which constitute the scanning line groups SLi of the display panel 110. The configuration made to apply the power supply voltage which has predetermined voltage value from the supply driver 160 to predetermined timing which synchronizes with the scanning signal Vsel outputted from the scanning driver 120 based on the supply control signal supplied from the system controller 140 is satisfactorily applicable.

In the display pixels mentioned above, although the circuit configuration corresponding to the current application method of the configuration which draws gradation current in the direction of the data driver via the data lines comprising three Thin-Film Transistors as a pixel driver circuit is shown, the present invention is not limited to this embodiment of a display device at least comprised of a pixel driver circuit which applies the current application method; a light generation control transistor which controls supply of the drive current to the light emitting devices; after a write-in control transistor controls a write-in operation of the gradation current and holds the gradation current (write-in current) according to the display data, as well as based on this gradation current, performs an "ON" operation of the above-mentioned light generation control transistor and light generation drive is supplied. This is what is necessary just to have another circuit configuration if the light emitting devices are made to emit light by predetermined luminosity gradation. For example, you may have a circuit configuration comprised with four Thin-Film Transistors and may have further configurations of the circuitry which applies (draws in) gradation currents to the data lines from the data driver.

Furthermore, in the embodiment mentioned above, although the configuration which applies the organic EL devices as the light emitting devices which constitute the display pixels is shown, the display device related to the present invention is not limited to this. If it is a current control type light emitting device which can perform luminescent operation by predetermined luminosity according to the current value for supplying the light generation drive current, light emitting diodes or other light emitting devices other than the organic EL devices mentioned above are satisfactorily applicable.

(Light Generation Structure of the Organic EL Devices)

Here, the structure of the organic EL devices applicable to the display pixels related to the embodiment mentioned above will be explained in detail.

Figure 14A:
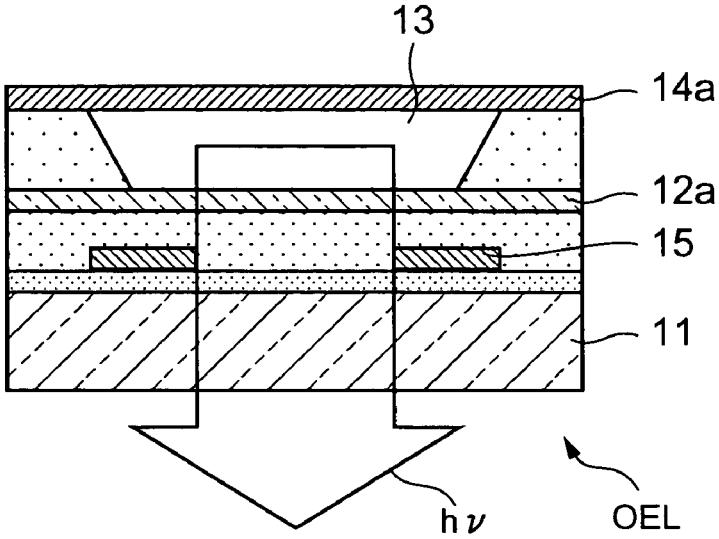
FIGS. 14A and 14B are outline sectional drawings showing the structure of the organic EL devices applicable to the display pixels of the display device related to this invention.
Figure 14B:
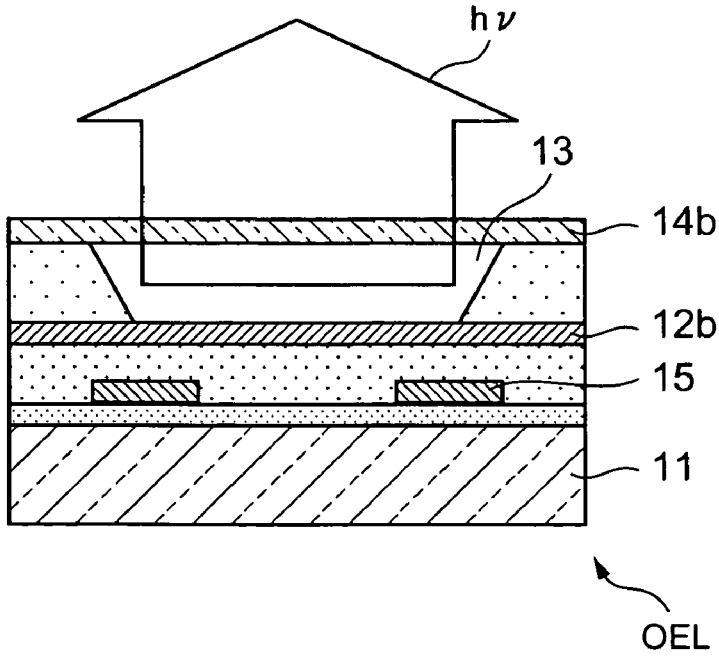
Figure 15A:
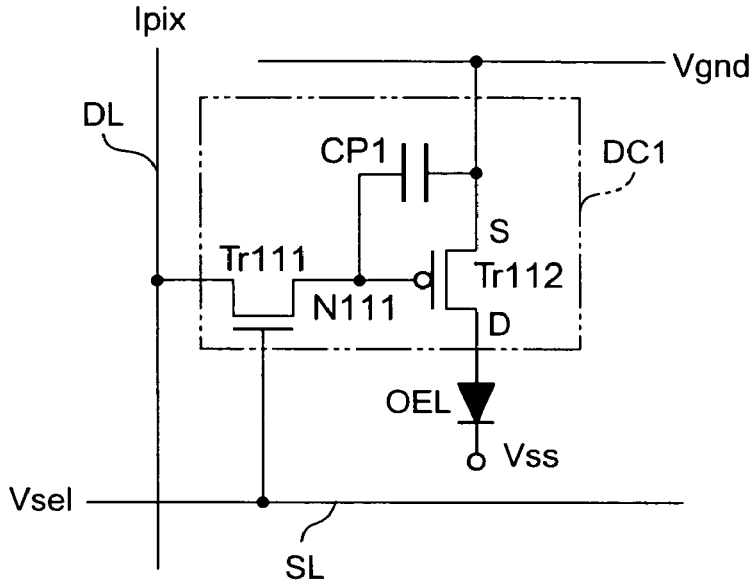
FIG. 15A PRIOR ART
FIGS. 15A and 15B are equivalent circuit drawings showing prior art example configurations as in the case of the display pixels applied to organic EL devices OEL as the light emitting devices in a self-luminescence type display.
Figure 15B:
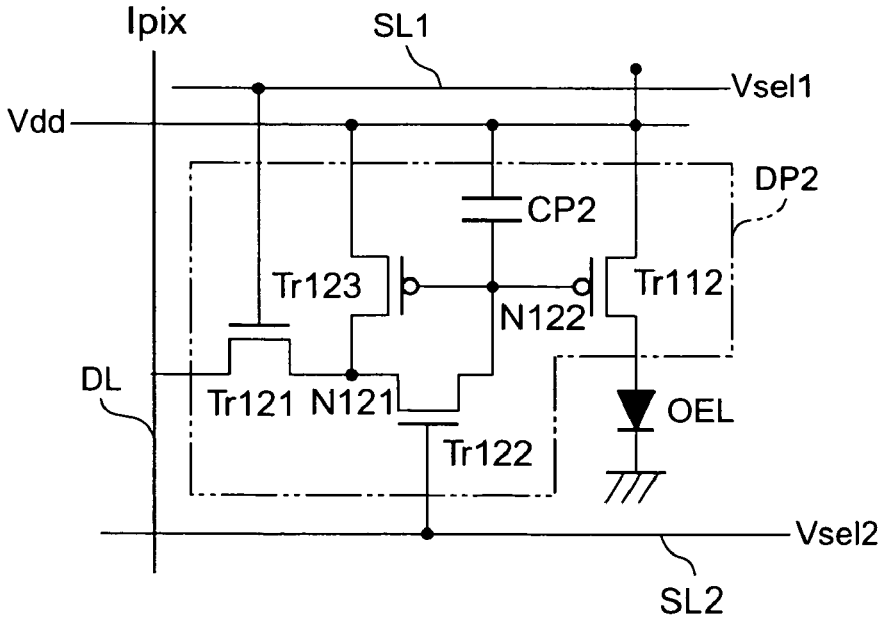
FIG. 15B PRIOR ART

FIGS. 14A and 14B are outline sectional drawings showing the structure of the organic EL devices applicable to the display pixels of the display device related to this invention.

As mentioned above, the display device related to the embodiment is connected with each of the scanning line groups SLi to which a single scanning signal is applied to every display pixel of a plurality of lines (for example, four lines) arranged in the display panel and the data line groups DLj which are each other composed of a plurality data lines (four) which have a configuration arranged in columns so that as to correspond to the display pixels of these plurality of lines. Specifically, the number of data lines arranged in the area between each other of the columns of each of the display pixels increases a plurality of times (fourfold) as compared to a display panel which has a configuration arranged with one data line for each and every column, and the wiring formation area provided between the above-mentioned columns is increased substantially.

Here, the structure of known organic EL devices of which one has a bottom emission structure as shown in FIG. 14A and one has a top emission structure as shown in FIG. 14B.

The bottom emission structure, as shown in FIG. 14A, has a configuration laminated sequentially on the entire surface side of a transparent insulating substrate 11, such as a glass substrate and the like, an anode electrode 12*a* (anode) composed of transparent electrode materials, such as Indium Tin Oxide (ITO) and the like, an organic EL layer 13 (luminescent layer) composed of luminescent materials of organic compound and the like, and a cathode electrode 14*a* (cathode) which has a reflection property composed of precious metal material. Here, within FIG. 14A, element 15 is a precious metal wiring layer to which each of the signals (the scanning signals, gradation current signals, power supply voltage, etc.) for performing light generation drive of the organic EL devices is supplied.

In such an organic EL device OEL, the energy at the time of the hole and the electron recombine within the organic EL layer 13 is radiated as light h V by applying positive voltage to the anode electrode 12*a* from a direct current voltage supply and negative voltage to the cathode electrode 14*a* and flowing direct current.

On the other hand, the top emission structure shown in FIG. 14B, the anode 12*b* which has a reflection property from the precious metal material on the entire surface side of the insulating substrate 11, the organic EL layer 13, the cathode electrode 14*b* composed of transparent electrode materials, such as Indium Tin Oxide (ITO) and the like, and has a configuration laminated sequentially. By applying positive voltage to the anode electrode 12*b* and negative voltage to the cathode electrode 14*b* and flowing direct current, the transparent cathode electrode 14*b* radiates permeated light hν.

When the organic EL devices OEL which have a bottom emission structure as shown in FIG. 14A is applied to the display device (display pixels) related to the embodiment, as mentioned above, since the number of data lines increases substantially, the wiring layer 15 arranged between the organic El devices (configuration which is composed of the anode electrode 12*a*, the cathode electrode 14*a* and the organic EL layer 13) and the insulating substrate 11 increases, the light h ν radiated from the organic EL layer 13 is blocked out by the data lines (wiring layer 15) and is influenced and the aperture ratio of the display panel declines.

Then, in the embodiment, for the structure of the organic EL devices, the organic EL devices OEL with the top emission structure shown in FIG. 14B are satisfactorily applicable.

More specifically, based on this top emission structure, a display panel with high surface brightness and satisfactory display image quality can be attained without the aperture ratio of the display panel declining. Even if it is the case where the number of data lines increased and the wiring formation area increases, because light h ν is radiated to the opposite direction with the insulating substrate 11 side in which the wiring layer 15 for performing the light generation drive of the organic EL devices OEL is formed.

While the present invention has been described with reference to the preferred embodiments, it is intended that the invention be not limited by any of the details of the description thereof.

As this invention can be embodied in several forms without departing from the spirit of the essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds thereof are intended to be embraced by the claims.

What is claimed is:

1. A driver circuit which drives each display pixel of a display panel comprising a plurality of display pixels arranged along a plurality of rows and a plurality of columns, the driver circuit comprising:

a pixel selection circuit which sets display pixels that are arranged in a predetermined number of rows and the plurality of columns of the display panel to a selection state simultaneously, wherein the predetermined number of rows is a section of at least two of the plurality of rows;

a current generation circuit; and a plurality of current holding circuits formed respectively corresponding to the plurality of columns;

wherein the current generation circuit, which is supplied with a gradation signal to provide a display gradation for each of the display pixels, (i) generates signal currents having current values corresponding to values of the gradation signals which correspond to the display pixels set to the selection state simultaneously by the pixel selection circuit, and (ii) sequentially supplies the signal currents corresponding to the display pixels of each column of the predetermined number of rows to each of the current holding circuits by timing in time series;

wherein each of the current holding circuits comprises a predetermined number of current storage circuits, where the predetermined number is equal to the number of rows set to the selection state simultaneously by the pixel selection circuit;

wherein each of the current storage circuits, which is supplied with the signal currents from the current generation circuit corresponding to the predetermined number of rows of the display pixels in time series, (i) takes-in and holds the signal current according to the timing in time series, and (ii) outputs simultaneously gradation currents based on the signal currents held in each of the display pixels for the predetermined number of rows set to the selection state simultaneously by the pixel selection circuit;

wherein each of the current storage circuits comprises a pair of current storage sections arranged in parallel; and wherein the pairs of current storage sections are controlled to perform simultaneously in parallel:

an operation which takes-in and holds the signal currents outputted from the current generation circuit in one of the pairs of current storage sections; and an operation which outputs the gradation currents to the display pixels based on the signal currents held in the other one of the pairs of current storage sections.

2. The driver circuit according to claim 1, wherein each of the current storage sections comprises a voltage component holding section which takes-in the signal currents outputted from the current generation circuit and holds a voltage component corresponding to the current values of the signal currents.

3. The driver circuit according to claim 1, wherein each of the current holding circuits comprises:

a first timing operation which holds a voltage component corresponding to the signal currents outputted from the current generation circuit; and a second timing operation which outputs the currents corresponding to the voltage component as the gradation currents.

4. The driver circuit according to claim 1, wherein the display pixels comprise current control type light emitting devices which perform luminescent operation by luminosity gradation according to the gradation currents.

5. The driver circuit according to claim 1, wherein the pixel selection circuit comprises a portion which applies a single scanning signal in common to the plurality of display pixels for the predetermined number of rows to set to the selection state.

6. The driver circuit according to claim 2, wherein the voltage component holding section comprises a capacitative element in which an electric charge is written in as the voltage component corresponding to the signal currents.

7. The driver circuit according to claim 6, wherein:

the voltage component holding section further comprises Field-Effect Transistors which flow the signal currents between a source-drain;

the capacitative element at least constitutes a parasitic capacitance between a source-gate of the Field-Effect Transistors; and the voltage between the source-gate based on the signal currents is written in the capacitative element.

8. A display device which displays image information comprising:

a display panel comprising a plurality of display pixels arranged along a plurality of rows and a plurality of columns, a plurality of scanning lines which are arranged in a row direction and connected to each of the display pixels, and a plurality of data lines which are arranged in a column direction and connected to each of the display pixels;

a scanning driver circuit which selects a predetermined number of the plurality of scanning lines of the display panel, and which selects simultaneously display pixels for a predetermined number of rows connected to the predetermined number of the scanning lines, wherein the predetermined number of scanning lines is a section of at least two of the plurality of scanning lines; and a signal driver circuit comprising a current generation circuit and a plurality of current holding circuits which correspond to each of the plurality of columns;

wherein the current generation circuit, which is supplied with display data to provide a display gradation for each of the display pixels, (i) generates signal currents having current values corresponding to values of the display data corresponding to the display pixels selected simultaneously by the scanning driver circuit, and (ii) sequentially supplies the signal currents corresponding to the display pixels of each column of the predetermined number of rows to each of the current holding circuits by timing in time series;

wherein each of the current holding circuits comprises a predetermined number of current storage circuits where the predetermined number is equal to the number of rows selected simultaneously by the scanning driver circuit;

wherein each of the current holding circuits, which is supplied with the signal currents from the current generation circuit corresponding to the predetermined number of rows of the display pixels in time series, (i) takes-in and holds the signal currents according to the timing in time series, and (ii) outputs simultaneously gradation currents based on the signal currents held in each of the display pixels for the predetermined number of rows selected simultaneously by the scanning driver circuit;

wherein each of the current storage circuits comprises a pair of current storage sections arranged in parallel; and wherein the pairs of current storage sections are controlled to perform simultaneously in parallel:

an operation which takes-in and holds the signal currents outputted to one of the pairs of current storage sections from the current generation circuit; and an operation which supplies the gradation currents to the data lines based on the signal currents held in the other one of the pairs of current storage sections.

9. The display device according to claim 8, wherein the display panel further comprises:

a plurality of scanning line groups wherein each group constitutes the predetermined number of scanning lines selected simultaneously by the scanning driver circuit;

a plurality of scanning signal lines which are connected to each of the plurality of scanning line groups; and a plurality of data line groups wherein each group constitutes, from among the plurality of data lines, a predetermined number of data lines which corresponds to a line count for the predetermined number of rows that are connected to each of the scanning line groups.

10. The display device according to claim 8, wherein each of the current storage sections comprises a voltage component holding section which takes-in the signal currents outputted from the current generation circuit and holds a voltage component corresponding to the current values of the signal currents.

11. The display device according to claim 8, wherein each of the current holding circuits comprises:

a first timing operation which holds a voltage component corresponding to the signal currents outputted from the current generation circuit; and a second timing operation which outputs the currents corresponding to the voltage component as the gradation currents.

12. The display device according to claim 8, wherein the display panel further comprises:

a single scanning line group which includes all of the plurality of scanning lines of the display panel, and a single scanning signal line connected to the single scanning line group; and wherein the scanning driver circuit applies a single scanning signal to the single scanning signal line and selects simultaneously all of the plurality of display pixels of the display panel.

13. The display device according to claim 8, wherein the display pixels comprise:

pixel driver circuits which generate drive currents having current values based on the gradation currents; and current control type display devices which operate by a display luminosity based on the current values of the drive currents.

14. The display device according to claim 9, wherein the scanning driver circuit sequentially applies a scanning signal to each of the plurality of scanning signal lines.

15. The display device according to claim 9, wherein the plurality of display pixels are arranged near each intersection point of each of the scanning lines and each of the data line groups.

16. The display device according to claim 9, wherein the data line groups are located in each area between columns of the display pixels arranged in the display panel.

17. The display device according to claim 9, wherein the plurality of current holding circuits are formed respectively corresponding to the plurality of the data line groups.

18. The display device according to claim 10, wherein the voltage component holding section comprises a capacitative element in which an electric charge is written in as the voltage component corresponding to the signal currents.

19. The display device according to claim 13, wherein the current control type display devices comprise light emitting devices which perform a light generation operation by a light generation luminosity based on the current values of the drive currents.

20. The display device according to claim 13, wherein each pixel driver circuit comprises:

a charge storage circuit for storing an electric charge associated with the gradation currents; and a drive control circuit for generating the drive currents supplied to a current control type display device based on the electric charge stored in the charge storage circuit.

21. The display device according to claim 17, wherein each of the plurality of the current storage circuits in each of the current holding circuits is formed corresponding to each of the predetermined number of data lines of each of the data line groups.

22. The display device according to claim 18, wherein:

the voltage component holding section further comprises Field-Effect Transistors which flow the signal currents between a source-drain;

the capacitative element at least constitutes a parasitic capacitance between a source-gate of the Field-Effect Transistors; and the voltage between the source-gate is written in the capacitative element based on the signal currents.

23. The display device according to claim 19, wherein the light emitting devices comprise organic electroluminescent devices.

24. The display device according to claim 23, wherein the organic electroluminescent devices are formed distributed on an entire surface side of a substrate where the scanning lines and the data lines are provided, and wherein the organic electroluminescent devices have a top emission structure that emits light radiated by the light generation operation in an opposite direction of the substrate.

25. The display device according to claim 20, wherein the display pixels are controlled so that the electric charges associated with the gradation currents are stored in the charge storage circuits of the pixel driver circuits during a selection period when the plurality of display pixels are selected simultaneously by the scanning driver circuit; and wherein the drive currents generated by the drive control circuits of the pixel driver circuits are supplied to the current control type display devices during a non-selection period when the plurality of display pixels are not selected.

26. The display device according to claim 25, wherein during the selection period of each of the display pixels, the current control type display devices are set to a non-operational state by shifting to a reverse-bias condition; and during the non-selection period of each of the display pixels, the current control type display devices are set to an operational state by shifting to a forward-bias condition.

27. A drive method of a display device which displays image information and which comprises: (i) a display panel comprising a plurality of display pixels arranged along a plurality of rows and a plurality of columns, a plurality of scanning lines which are arranged in a row direction and connected to each of the display pixels, and a plurality of data lines which are arranged in a column direction and connected to each of the display pixels; (ii) a scanning driver circuit which selects simultaneously display pixels of a predetermined number of rows that are connected to at least a section of a predetermined number of the scanning lines of the display panel; and (iii) a signal driver circuit comprising a current generation circuit and a plurality of current holding circuits, each of the plurality of current holding circuits including a predetermined number of current storage circuits where the predetermined number is equal to the number of rows selected simultaneously by the scanning driver circuit, each of the plurality of current storage circuits including a pair of current storage sections arranged in parallel, and the plurality of current holding circuits respectively formed corresponding to the plurality of columns, the method comprising:

supplying a display data which provides a display gradation for each of the display pixels to the current generation circuit of the signal driver circuit;

generating signal currents having current values corresponding to values of the display data which correspond to the display pixels selected simultaneously by the scanning driver circuit;

sequentially supplying the signal currents corresponding to the display pixels of each column of the predetermined number of rows to each of the current holding circuits by timing in time series;

taking-in and holding sequentially the signal currents in one of the pairs of current storage sections included in each of the predetermined number of current storage circuits of each of the current holding circuits by timing in time series;

outputting simultaneously, from the predetermined number of current storage circuits of each of the current holding circuits, gradation currents to the plurality of data lines based on the signal currents taken-in and held in the other one of the pairs of current storage sections included in each of the current storage circuits, and continuing the outputting in a period set to the simultaneous selection, wherein the taking-in of the signal currents as the signal currents for each of the display pixels and the outputting of the gradation currents based on the signal currents are performed simultaneously in parallel;

selecting simultaneously the predetermined number of the scanning lines by the scanning driver circuit;

writing-in the gradation currents output to the predetermined number of rows of the display pixels selected simultaneously; and operating the predetermined number of rows of the display pixels in which the gradation currents have been written-in at a display luminosity based on current values of the gradation currents.

28. The drive method according to claim 27, further comprising, in each of the display pixels:

storing an electric charge associated with the gradation currents; and generating drive currents based on the stored electric charge and supplying the generated drive currents to a current control type display device, wherein the current control type display device operates by a display luminosity based on current values of the drive currents;

wherein the electric charge associated with the gradation currents are stored in a charge storage circuit of a pixel driver circuit, and wherein the write-in of the gradation currents is performed in a selection period when the predetermined number of scanning lines are selected by the scanning driver circuit; and wherein the drive currents are supplied to the current control type display device based on the electric charge accumulated in the charge storage circuit by a drive control circuit of the pixel driver circuit during a non-selection period when the predetermined number of scanning lines are not selected.

29. The drive method according to claim 28, wherein during the selection period of each of the display pixels, the current control type display device is set in a non-operational state by shifting into a reverse-bias condition; and during the non-selection period of each of the display pixels, the current control type display device is set to an operational state by shifting into a forward-bias condition.

* * * * *